US010744763B2

(12) United States Patent
Takagi et al.

(10) Patent No.: US 10,744,763 B2
(45) **Date of Patent: *Aug. 18, 2020**

(54) LIQUID DISCHARGE APPARATUS

(71) Applicant: BROTHER KOGYO KABUSHIKI KAISHA, Nagoya-shi, Aichi-ken (JP)

(72) Inventors: Yuki Takagi, Nagoya (JP); Mikio Ogawa, Nagoya (JP); Toshiro Ueda, Inazawa (JP)

(73) Assignee: BROTHER KOGYO KABUSHIKI KAISHA, Nagoya-shi, Aichi-ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/384,088

(22) Filed: Apr. 15, 2019

(65) Prior Publication Data

US 2019/0308411 A1 Oct. 10, 2019

Related U.S. Application Data

(63) Continuation of application No. 15/938,054, filed on Mar. 28, 2018, now Pat. No. 10,300,696.

(30) Foreign Application Priority Data

Mar. 31, 2017 (JP) ..... 2017-072168

(51) Int. Cl.
*B41J 2/045* (2006.01)
*B41J 2/175* (2006.01)
*B41J 29/13* (2006.01)

(52) U.S. Cl.
CPC ..... *B41J 2/04586* (2013.01); *B41J 2/1752* (2013.01); *B41J 2/17513* (2013.01);
(Continued)

(58) Field of Classification Search
CPC ..... B41J 2/17566; B41J 2/17523; B41J 2/17509; B41J 2/17553; B41J 2/17513; B41J 2/1752; B41J 2/04586
See application file for complete search history.

(56) References Cited

U.S. PATENT DOCUMENTS 7,658,470 B1 2/2010 Jones et al.
8,100,500 B2 1/2012 Bansyo
(Continued)

FOREIGN PATENT DOCUMENTS

JP 2008-213162 A 9/2008

OTHER PUBLICATIONS

U.S. Appl. No. 15/938,032, filed Mar. 28, 2018.
(Continued)

*Primary Examiner* — Julian D Huffman
(74) *Attorney, Agent, or Firm* — Scully, Scott, Murphy & Presser, P.C.

(57) ABSTRACT

A liquid discharge apparatus includes a case receiving a cartridge, a tank, a head, and a controller to: when the cartridge is installed in the case, calculate an outflow amount Qc based on heights Hc, Hs and flow path resistances; read the amounts Vc, Vs from a memory; subtract the outflow amount Qc from the read liquid amount Vc to calculate new liquid amount Vc; add the outflow amount Qc to the read liquid amount Vs to calculate new liquid amount Vs; store the calculated liquid amounts Vc, Vs in the memory; after a time period from at the time the calculated liquid amounts Vc, Vs stored elapses, again calculate the outflow amount Qc and the liquid amounts Vc, Vs and store the calculated liquid amounts Vc, Vs in the memory.

16 Claims, 11 Drawing Sheets

(52) U.S. Cl.
CPC ..... *B41J 2/17523* (2013.01); *B41J 2/17546* (2013.01); *B41J 2/17553* (2013.01); *B41J 2/17566* (2013.01); *B41J 29/13* (2013.01); *B41J 2002/17569* (2013.01); *B41J 2002/17573* (2013.01); *B41J 2002/17589* (2013.01)

(56) References Cited

U.S. PATENT DOCUMENTS

| | | | |
|---|---|---|---|
| 8,708,472 | B2 | 4/2014 | Ohnishi |
| 10,279,594 | B2 | 5/2019 | Horade et al. |
| 10,279,595 | B2 | 5/2019 | Morimoto et al. |
| 10,300,696 | B2 * | 5/2019 | Takagi ..... B41J 2/04586 |
| 10,322,587 | B2 | 6/2019 | Ogawa et al. |
| 10,603,919 | B2 | 3/2020 | Horade |
| 2002/0024543 | A1 | 2/2002 | Kimura et al. |
| 2005/0185035 | A1 | 8/2005 | Takei |
| 2008/0204488 | A1 | 8/2008 | Usui |
| 2009/0201351 | A1 | 8/2009 | Shimizu et al. |

OTHER PUBLICATIONS

United States Notice of Allowance dated Jan. 14, 2019 received in U.S. Appl. No. 15/938,054.
United States Notice of Allowance dated Feb. 6, 2019 received in related U.S. Appl. No. 15/938,032.
U.S. non-Final Office Action dated Apr. 15, 2020 received in related U.S. Appl. No. 16/404,026.

* cited by examiner

LIQUID DISCHARGE APPARATUS

CROSS-REFERENCE TO RELATED APPLICATION

This application is a continuation application of U.S. Ser. No. 15/938,054 filed on Mar. 28, 2018 and claims priority from Japanese Patent Application No. 2017-072168 filed on Mar. 31, 2017, the entire subject-matter of which is incorporated herein by reference.

TECHNICAL FIELD

The disclosure relates to a liquid discharge apparatus configured to discharge liquid.

BACKGROUND

There has been proposed an inkjet printer including a detachable main tank, a sub-tank configured to store therein ink supplied from the installed main tank, and an image recording unit configured to record an image by discharging the ink stored in the sub-tank. Internal spaces of the main tank and the sub-tank open to the atmosphere. For this reason, when the main tank is installed in the inkjet printer, the ink moves so that liquid levels of the main tank and the sub-tank are to be the same height, by a difference (hereinafter, referred to as "water head difference") between a water head of the internal space of the main tank and a water head of the internal space of the sub-tank. Then, when the water head difference is substantially solved (hereinafter, referred to as "equivalent state"), the movement of ink is completed.

SUMMARY

Illustrative aspects of the disclosure provides a liquid discharge apparatus includes a case receiving a cartridge, a tank, a head, and a controller to: when the cartridge is installed in the case, calculate an outflow amount Qc based on heights Hc, Hs and flow path resistances; read the liquid amounts Vc, Vs from a memory; subtract the outflow amount Qc from the read liquid amount Vc to calculate new liquid amount Vc; add the outflow amount Qc to the read liquid amount Vs to calculate new liquid amount Vs; store the calculated liquid amounts Vc, Vs in the memory; after a time period from at the time the calculated liquid amounts Vc, Vs stored elapses, again calculate the outflow amount Qc and the liquid amounts Vc, Vs and store the calculated liquid amounts Vc, Vs in the memory.

BRIEF DESCRIPTION OF THE DRAWINGS

FIGS. 1A and 1B are perspective views of a printer 10, in which FIG. 1A depicts a state where a cover 87 is located at a covering position and FIG. 1B depicts a state where the cover 87 is located at an exposed position;

FIGS. 4A and 4B depict a structure of a cartridge 200, in which FIG. 4A is a front perspective view and FIG. 4B is a longitudinal sectional view;

FIGS. 10A and 10B are pictorial views depicting a state where a tank 160 and the cartridge 200 communicate with each other, in which FIG. 10A depicts a state where a brand-new cartridge 200 communicates with the tank 160 in which ink is not stored, and FIG. 10B depicts a state where a part of ink stored in the cartridge 200 has moved to the tank 160; and FIGS. 11A and 11B are pictorial views depicting a state where the tank 160 and the cartridge 200 communicate with each other, in which FIG. 11A depicts a state where liquid levels of the tank 160 and the cartridge 200 are flush with each other, and FIG. 11B depicts a cartridge empty state.

DETAILED DESCRIPTION

Figure 1A:
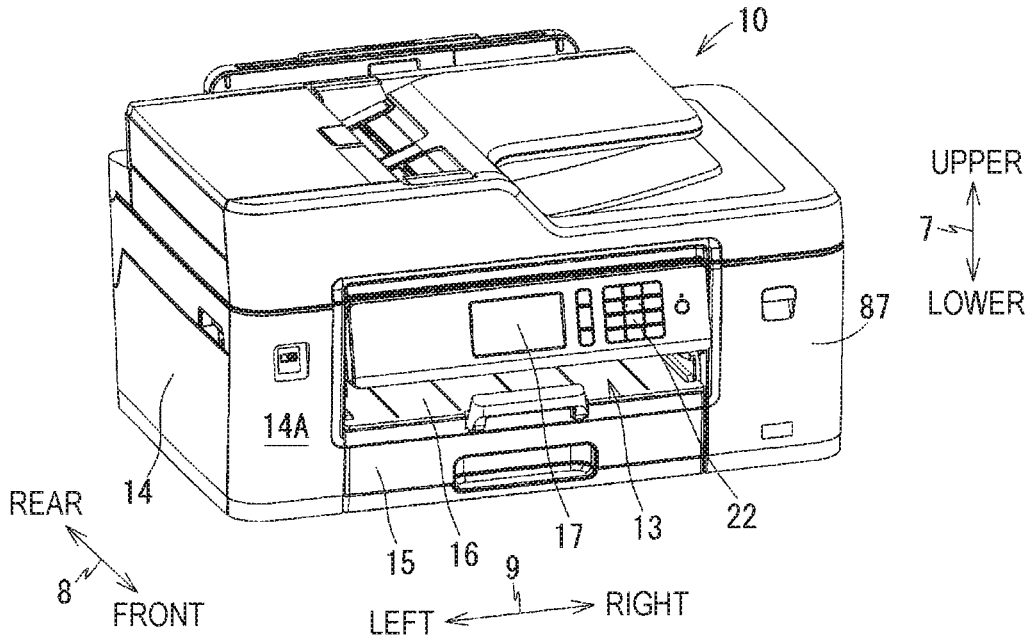

As described above, it is anticipated that it takes some time from the state in which the water head difference occurs to the equivalent state. However, it is not easy to individually perceive ink amounts in the main tank and the sub-tank for a time period until the equivalent state.

The disclosure has been made in view of the above situations, and is to provide a liquid discharge apparatus capable of individually perceiving amounts of liquids respectively stored in a first liquid chamber and a second liquid chamber.

Hereinafter, an illustrative embodiment of the disclosure will be described. In the meantime, the illustrative embodiment to be described later is just an example of the disclosure, and can be appropriately changed without changing the gist of the disclosure. Also, an upper and lower direction 7 is defined on the basis of a posture where a printer 10 is put to be useable on a horizontal surface, a front and rear direction 8 is defined, when a surface on which an opening 13 of the printer 10 is formed is set as a front surface, and a right and left direction 9 is defined, when the printer 10 is seen from the front surface. In the illustrative embodiment, at a using posture, the upper and lower direction 7 corresponds to the vertical direction, and the front and rear direction 8 and the right and left direction 9 correspond to the horizontal direction. The front and rear direction 8 and the right and left direction 9 are perpendicular to each other.

(Outline of Printer 10)

The printer 10 of the illustrative embodiment is an example of the liquid discharge apparatus configured to record an image on a sheet in an inkjet recording manner. The printer 10 has a housing 14 having a substantially rectangular parallelepiped shape. Also, the printer 10 may be a so-called "complex machine" having functions such as facsimile, scan and copy functions and the like.

Figure 1B:
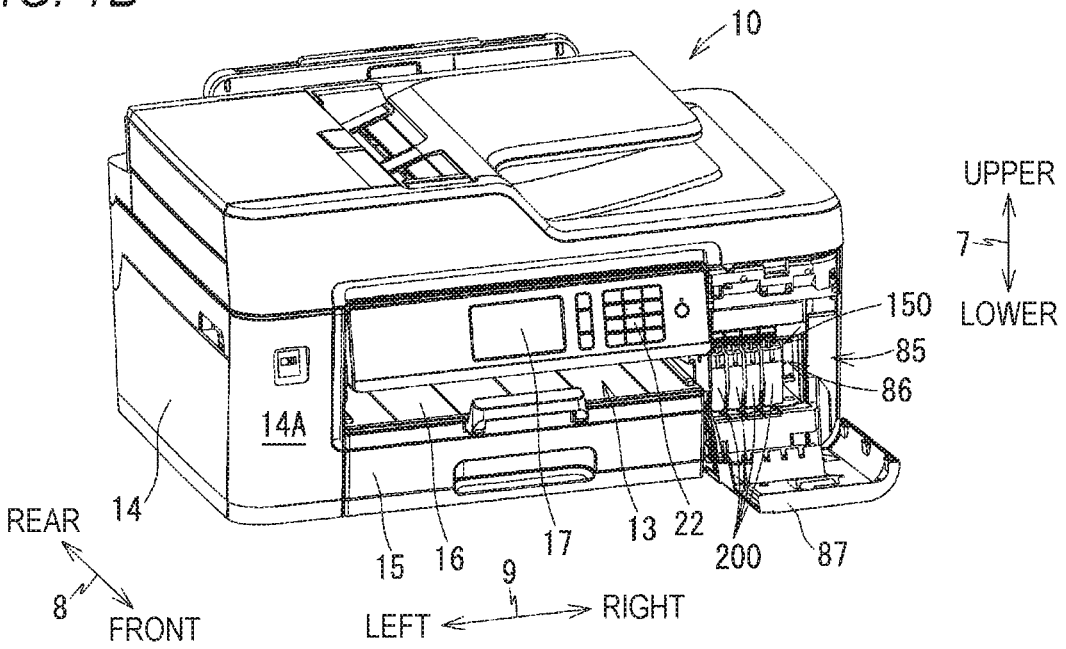
Figure 2:
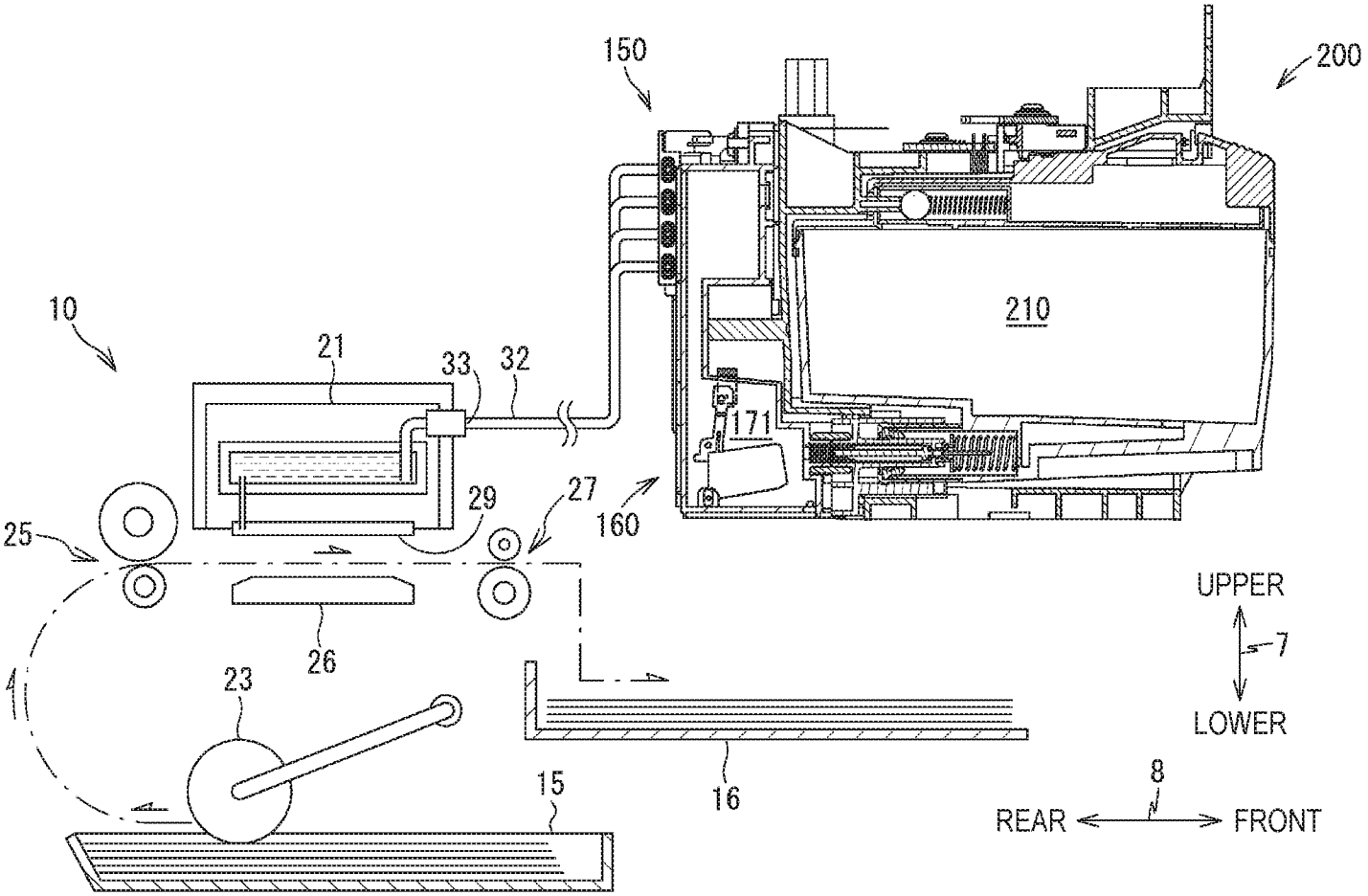
FIG. 2 is a pictorial sectional view depicting an internal structure of the printer 10.

As shown in FIGS. 1 and 2, in the housing 14, a feeder tray 15, a feeder roller 23, conveyer rollers 25, a head 21 having a plurality of nozzles 29, a platen 26 configured to face the head 21, discharge rollers 27, a discharge tray 16, an installation case 150 to which a cartridge 200 is to be detachably installed, and a tube 32 configured to cause the head 21 and the cartridge 200 installed in the installation case 150 to communicate with each other are positioned.

The printer 10 is configured to drive the feeder roller 23 and the conveyer rollers 25, thereby conveying a sheet supported in the feeder tray 15 to a position of the platen 26. Then, the printer 10 is configured to enable the head 21 to discharge ink, which is supplied through the tube 32 from the cartridge 200 installed in the installation case 150, through the nozzles 29. Thereby, the ink is spotted to the sheet supported to the platen 26, so that an image is recorded on the sheet. Then, the printer 10 is configured to drive the discharge rollers 27, thereby discharging the sheet having the image recorded thereon to the discharge tray 16.

More specifically, the head 21 may be mounted to a carriage configured to reciprocally move in a main scanning direction intersecting with a sheet conveying direction by the conveyer rollers 25. The printer 10 may be configured to enable the head 21 to discharge the ink through the nozzles 29 while moving the carriage from one side to the other side in the main scanning direction. Thereby, an image is recorded to a region (hereinafter, referred to as "one pass") of a part of the sheet facing the head 21. Then, the printer 10 may be configured to enable the conveyer rollers 25 to convey the sheet so that a region in which an image is to be recorded next time faces the head 21. The above processing is alternately and repeatedly executed, so that images are recorded on one sheet.

(Cover 87)

As shown in FIGS. 1A and 1B, a right end portion of a front surface 14A of the housing 14 in the right and left direction 9 is formed with an opening 85. The housing 14 further includes a cover 87. The cover 87 can rotate between a covering position (a position shown in FIG. 1A) at which the opening 85 is covered and an exposed position (a position shown in FIG. 1B) at which the opening 85 is exposed. The cover 87 is supported to the housing 14 in the vicinity of a lower end of the housing 14 in the upper and lower direction 7 so that it can rotate about a rotation axis along the right and left direction 9, for example. The installation case 150 is located in an accommodation space 86 inside the housing 14, which becomes wider rearward from the opening 85.

(Cover Sensor 88)

Figure 6:
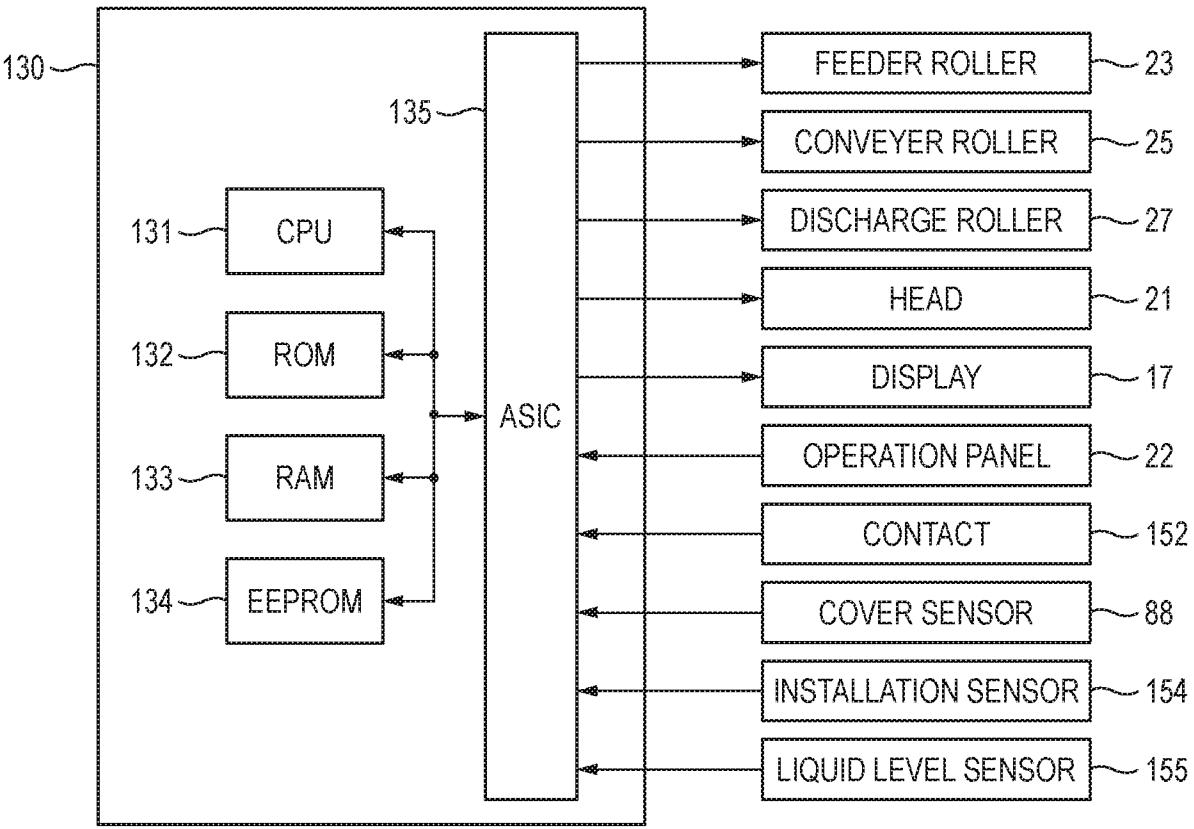
FIG. 6 is a block diagram of the printer 10.

The printer 10 includes a cover sensor 88 (refer to FIG. 6). The cover sensor 88 may be a mechanical sensor such as a switch, which the cover 87 is connected and separated thereto and therefrom, or an optical sensor in which light is shielded or enabled to pass depending on a position of the cover 87, for example. The cover sensor 88 is configured to output a signal corresponding to a position of the cover 87 to a controller 130. More specifically, when the cover 87 is located at the covering position, the cover sensor 88 outputs a low level signal to the controller 130. On the other hand, when the cover 87 is located at a position different from the covering position, the cover sensor 88 outputs a high level signal of which a signal intensity is higher than the low level signal to the controller 130. In other words, the cover sensor 88 is configured to output the high level signal to the controller 130, in response to the cover 87 being located at the exposed position. The high level signal is an example of the third signal, and the low level signal is an example of the fourth signal.

(Installation Case 150)

Figure 3:
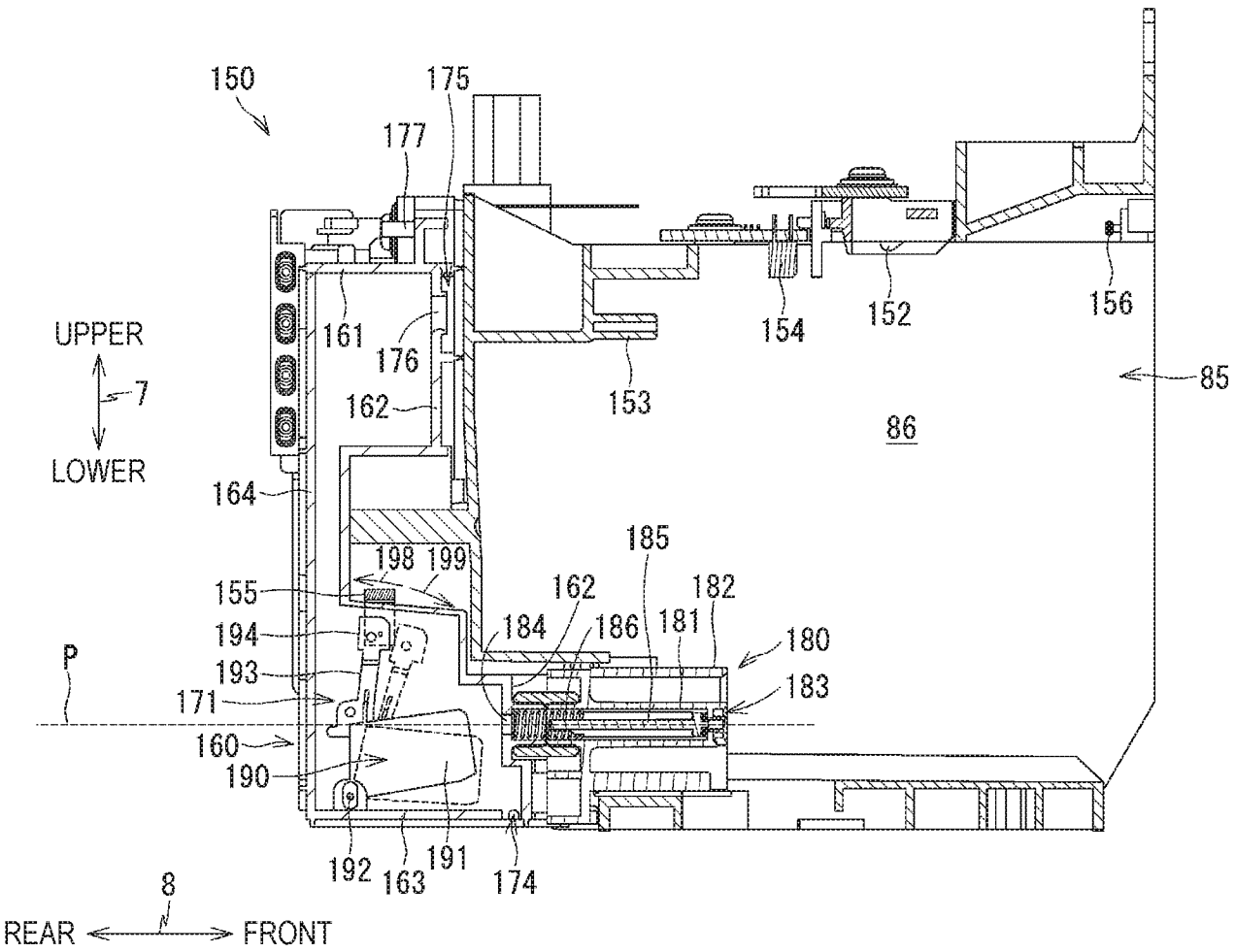
FIG. 3 is a longitudinal sectional view of an installation case 150.

As shown in FIG. 3, the installation case 150 includes contacts 152, rods 153, installation sensors 154, liquid level sensors 155, and a lock pin 156. In the installation case 150, four cartridges 200 corresponding to respective colors of black, cyan, magenta and yellow can be accommodated. That is, the installation case 150 includes the four contacts 152, rods 153, installation sensors 154, and liquid level sensors 155, in correspondence to the four cartridges 200. In the meantime, the number of the cartridges 200 to be installed in the installation case 150 is not limited to four and may be one or five or more.

The installation case 150 has a box shape having an internal space in which the installed cartridges 200 are accommodated. The internal space of the installation case 150 is demarcated by a top wall demarcating an upper end, a bottom wall demarcating a lower end, an inner wall demarcating a rear end in the front and rear direction 8, and a pair of sidewalls demarcating both ends in the right and left direction 9. In the meantime, a position facing the inner wall of the installation case 150 is configured by the opening 85. That is, the opening 85 exposes the internal space of the installation case 150 to an outside of the printer 10 when the cover 87 is arranged at the exposed position.

The cartridge 200 is inserted into the installation case 150 and is removed from the installation case 150 through the opening 85 of the housing 14. More specifically, the cartridge 200 passes through the opening 85 rearward in the front and rear direction 8, and is installed in the installation case 150. The cartridge 200 that is removed from the installation case 150 passes through the opening 85 forward in the front and rear direction 8.

(Contact 152)

The installation case 150 has an interface. The contact 152 is one example of the interface. The contact 152 is located on the top wall of the installation case 150. The contact 152 protrudes downward from the top wall toward the internal space of the installation case 150. The contact 152 is located at a position at which it is contacted to electrodes 248 (which will be described later) of the cartridge 200 in a state where the cartridge 200 is installed in the installation case 150. The contact 152 is conductive and can be elastically deformed in the upper and lower direction 7. The contact 152 is electrically connected to the controller 130. Incidentally, the interface may be configured by a wireless interface.

(Rod 153)

The rod 153 protrudes forward from the inner wall of the installation case 150. The rod 153 is located above a joint 180 (which will be described later) on the inner wall of the installation case 150. The rod 153 is introduced into an atmosphere valve chamber 214 through an atmosphere communication port 221 (which will be described later) of the cartridge 200 while the cartridge 200 is being installed in the installation case 150. When the rod 153 is introduced into the atmosphere valve chamber 214, the atmosphere valve chamber 214 (which will be described later) communicates with the atmosphere.

(Installation Sensor 154)

The installation sensor 154 is located on the top wall of the installation case 150. The installation sensor 154 is a sensor configured to determine whether the cartridge 200 is installed in the installation case 150. The installation sensor 154 includes a light emitting unit and a light receiving unit spaced in the right and left direction 9. In the state where the cartridge 200 is installed in the installation case 150, a light shield rib 245 (which will be described later) of the cartridge 200 is positioned between the light emitting unit and the light receiving unit of the installation sensor 154. In other words, the light emitting unit and the light receiving unit of the installation sensor 154 are positioned to face each other with the light shield rib 245 of the cartridge 200 installed in the installation case 150 being interposed therebetween.

The installation sensor 154 is configured to output different signals (denoted as "installation signals" in the drawings), depending on whether light irradiated from the light emitting unit in the right and left direction 9 is received at the light receiving unit. The installation sensor 154 outputs a low level signal to the controller 130 when a light receiving intensity of the light received at the light receiving unit is lower than a threshold intensity, for example. On the other hand, the installation sensor 154 outputs a high level signal having a signal intensity higher than the low level signal to the controller 130 when the light receiving intensity of the light received at the light receiving unit is equal to or higher than the threshold intensity. The high level signal is an example of the first signal, and the low level signal is an example of the second signal.

(Liquid Level Sensor 155)

The liquid level sensor 155 is a sensor configured to detect whether a part to be detected 194 of an actuator 190 (which will be described later) is located at a detection position. The liquid level sensor 155 includes a light emitting unit and a light receiving unit spaced in the right and left direction 9. In other words, the light emitting unit and the light receiving unit of the liquid level sensor 155 are positioned to face each other with the part to be detected 194 located at the detection position being interposed therebetween. The liquid level sensor 155 is configured to output different signals (denoted as "liquid level signals" in the drawings), depending on whether light emitted from the light emitting unit is received at the light receiving unit.

(Lock Pin 156)

The lock pin 156 is a rod-shaped member extending in the right and left direction 9 at the upper end of the internal space of the installation case 150 and in the vicinity of the opening 85. Both ends of the lock pin 156 in the right and left direction 9 are fixed to the pair of sidewalls of the installation case 150. The lock pin 156 extends in the right and left direction 9 over the four spaces in which the four cartridges 200 can be accommodated. The lock pin 156 is to hold the cartridge 200 installed in the installation case 150 at an installation position shown in FIG. 5. The cartridge 200 is engaged to the lock pin 156 with being installed in the installation case 150.

(Tank 160)

The printer 10 includes four tanks 160, in correspondence to the four cartridges 200. The tank 160 is positioned at the rear of the inner wall of the installation case 150. As shown in FIG. 3, the tank 160 is configured by an upper wall 161, a front wall 162, a lower wall 163, a rear wall 164, and a pair of sidewalls (not shown). In the meantime, the front wall 162 is configured by a plurality of walls each of which deviates in the front and rear direction 8. The tank 160 is formed therein with a liquid chamber 171. The liquid chamber 171 is an example of the second liquid chamber.

Of the walls configuring the tank 160, at least a wall facing the liquid level sensor 155 has a light-transmitting property. Thereby, the light output from the liquid level sensor 155 can penetrate the wall facing the liquid level sensor 155. At least a part of the rear wall 164 may be a film that is to be welded to end faces of the upper wall 161, the lower wall 163, and the sidewalls. Also, the sidewalls of the tank 160 may be common to the installation case 150 or may be provided separately from the installation case 150. Also, the tanks 160 adjacent in the right and left direction 9 are partitioned by partition walls (not shown). The configurations of the four tanks 160 are substantially common.

The liquid chamber 171 is configured to communicate with an ink flow path (not shown) through an outflow port 174. A lower end of the outflow port 174 is demarcated by the lower wall 163 demarcating a lower end of the liquid chamber 171. The outflow port 174 is located below the joint 180 (more specifically, a lower end of a through-hole 184) in the upper and lower direction 7. The ink flow path (not shown) configured to communicate with the outflow port 174 is configured to communicate with the tube 32. Thereby, the liquid chamber 171 communicates with the head 21 from the outflow port 174 through the ink flow path and the tube 32. That is, the ink stored in the liquid chamber 171 is supplied from the outflow port 174 to the head 21 through the ink flow path and the tube 32. The ink flow path and the tube 32 configured to communicate with the outflow port 174 are an example of the fourth flow path of which one end (the outflow port 174) is configured to communicate with the liquid chamber 171 and the other end 33 (refer to FIG. 2) is configured to communicate with the head 21.

The liquid chamber 171 is configured to communicate with the atmosphere through an atmosphere communication chamber 175. More specifically, the atmosphere communication chamber 175 is configured to communicate with the liquid chamber 171 via a through-hole 176 penetrating the front wall 162. Also, the atmosphere communication chamber 175 is configured to communicate with the outside of the printer 10 through an atmosphere communication port 177 and a tube (not shown) connected to the atmosphere communication port 177. That is, the atmosphere communication chamber 175 is an example of the fifth flow path of which one end (the through-hole 176) is configured to communicate with the liquid chamber 171 and the other end (the atmosphere communication port 177) is configured to communicate with the outside of the printer 10. In the meantime, the atmosphere communication chamber 175 is configured to communicate with the atmosphere through the atmosphere communication port 177 and the tube (not shown).

(Joint 180)

As shown in FIG. 3, the joint 180 has a needle 181 and a guide 182. The needle 181 is a pipe having a flow path formed therein. The needle 181 protrudes forward from the front wall 162 demarcating the liquid chamber 171. A protruding leading end of the needle 181 is formed with an opening 183. Also, an internal space of the needle 181 is configured to communicate with the liquid chamber 171 through a through-hole 184 penetrating the front wall 162. The needle 181 is an example of the third flow path of which one end (the opening 183) is configured to communicate with an outside of the tank 160 and the other end (the through-hole 184) is configured to communicate with the liquid chamber 171. The guide 182 is a cylindrical member arranged around the needle 181. The guide 182 protrudes forward from the front wall 162, and a protruding end thereof is opened.

In the internal space of the needle 181, a valve 185 and a coil spring 186 are positioned. The valve 185 can move in the front and rear direction 8 between a closed position and an opened position, in the internal space of the needle 181. The valve 185 is configured to close the opening 183 at the closed position. Also, the valve 185 is configured to open the opening 183 at the opened position. The coil spring 186 is configured to urge the valve 185 in a direction of moving the same from the opened position toward the closed position, i.e., forward in the front and rear direction 8.

(Actuator 190)

In the liquid chamber 171, an actuator 190 is positioned. The actuator 190 is supported to be rotatable in directions of arrows 198, 199 by a support member (not shown) arranged in the liquid chamber 171. The actuator 190 can be rotated between a position shown with a solid line in FIG. 3 and a position shown with a broken line. Also, the actuator 190 is restrained from being further rotated in the direction of the arrow 198 than the position shown with the solid line by a stopper (not shown) (for example, the inner wall of the liquid chamber 171). The actuator 190 includes a float 191, a shaft 192, an arm 193, and a part to be detected 194.

The float 191 is formed of a material having a specific weight less than the ink to be stored in the liquid chamber 171. The shaft 192 protrudes from right and left surfaces of the float 191 in the right and left direction 9. The shaft 192 is inserted into a hole (not shown) formed in the support member. Thereby, the actuator 190 is supported to be rotatable about the shaft 192 by the support member. The arm 193 extends substantially upward from the float 191. The part to be detected 194 is positioned at a protruding leading end portion of the arm 193. The part to be detected 194 is a plate-shaped member extending in the upper and lower direction 7 and in the front and rear direction 8. The part to be detected 194 is formed of a material or color capable of shielding the light emitted from the light emitting unit of the liquid level sensor 155.

When the liquid level of the ink in the liquid chamber 171 is equal to or higher than a boundary position P, the actuator 190 rotated in the direction of the arrow 198 by the buoyancy force is kept at a detection position shown with the solid line in FIG. 3 by the stopper. On the other hand, when the liquid level of the ink is lower than the boundary position P, the actuator 190 is rotated in the direction of the arrow 199 in conformity to the lowering of the liquid level. Thereby, the part to be detected 194 is moved to a position deviating from the detection position. That is, the part to be detected 194 is moved to a position corresponding to an amount of the ink stored in the liquid chamber 171.

The boundary position P is a height in the upper and lower direction 7, which is the same as an axial center of the needle 181 and is also the same as a center of an ink supply port 234 (which will be described later). However, the boundary position P is not limited to the above position inasmuch as it is located at a position higher than the outflow port 174 in the upper and lower direction 7. As another example, the boundary position P may be a height of an upper end or lower end of the internal space of the needle 181 or may be a height of an upper end or lower end of the ink supply port 234.

When the liquid level of the ink stored in the liquid chamber 171 is equal to or higher than the boundary position P, the light emitted from the light emitting unit of the liquid level sensor 155 is shielded by the part to be detected 194. Thereby, since the light emitted from the light emitting unit does not reach the light receiving unit, the liquid level sensor 155 outputs a low level signal to the controller 130. On the other hand, when the liquid level of the ink stored in the liquid chamber 171 is lower than the boundary position P, since the light emitted from the light emitting unit reaches the light receiving unit, the liquid level sensor 155 outputs a high level signal to the controller 130. That is, the controller 130 can detect whether the liquid level of the ink in the liquid chamber 171 is equal to or higher than the boundary position P, based on a signal to be output from the liquid level sensor 155.

(Cartridge 200)

Figure 4A:
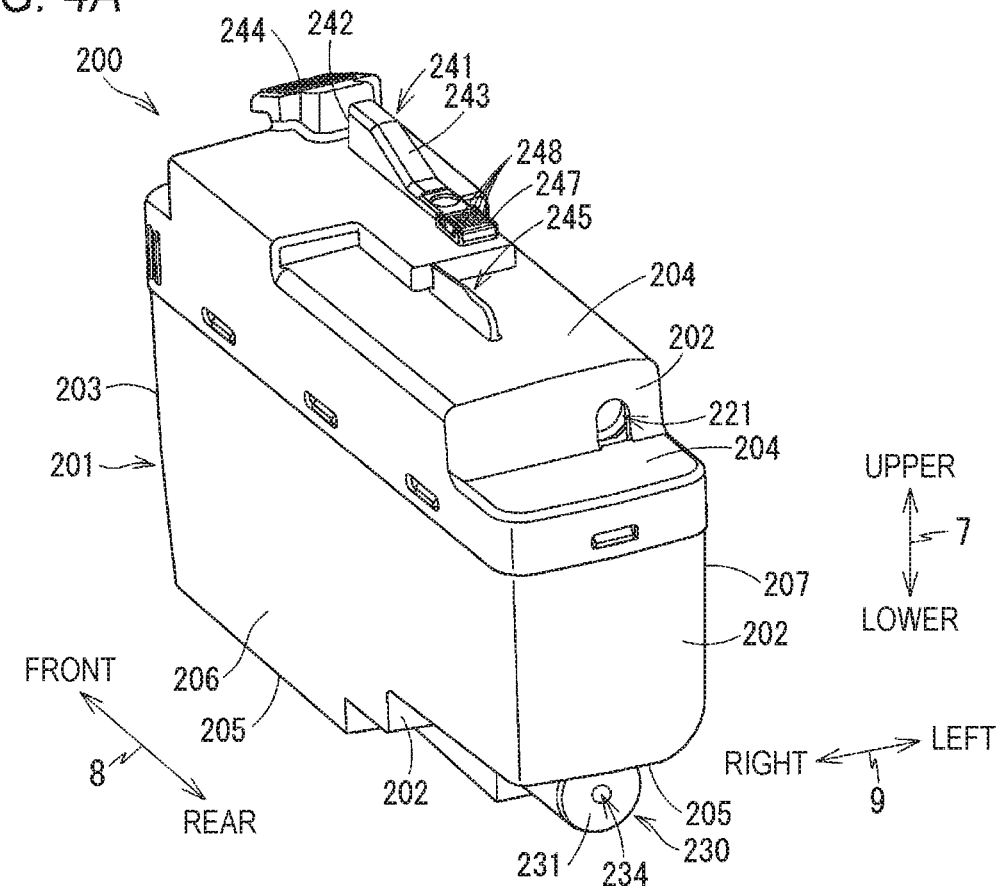

The cartridge 200 is a receptacle having a liquid chamber 210 (refer to FIG. 2) capable of storing therein the ink that is an example of the liquid. The liquid chamber 210 is demarcated by resin walls, for example. As shown in FIG. 4A, the cartridge 200 has a flat shape of which sizes in the upper and lower direction 7 and in the front and rear direction 8 are larger than a size in the right and left direction 9. In the meantime, outer shapes of the cartridges 200 in which inks of different colors are stored may be the same or may be different. At least a part of walls constituting the cartridge 200 has a light-transmitting property. Thereby, a user can visually recognize the liquid level of the ink stored in the liquid chamber 210 of the cartridge 200 from an outside of the cartridge 200.

The cartridge 200 includes a housing 201 and a supply pipe 230. The housing 201 is configured by a rear wall 202, a front wall 203, an upper wall 204, a lower wall 205, and a pair of sidewalls 206, 207. In the meantime, the rear wall 202 is configured by a plurality of walls each of which deviates in the front and rear direction 8. Also, the upper wall 204 is configured by a plurality of walls each of which deviates in the upper and lower direction 7. Also, the lower wall 205 is configured by a plurality of walls each of which deviates in the upper and lower direction 7.

Figure 4B:
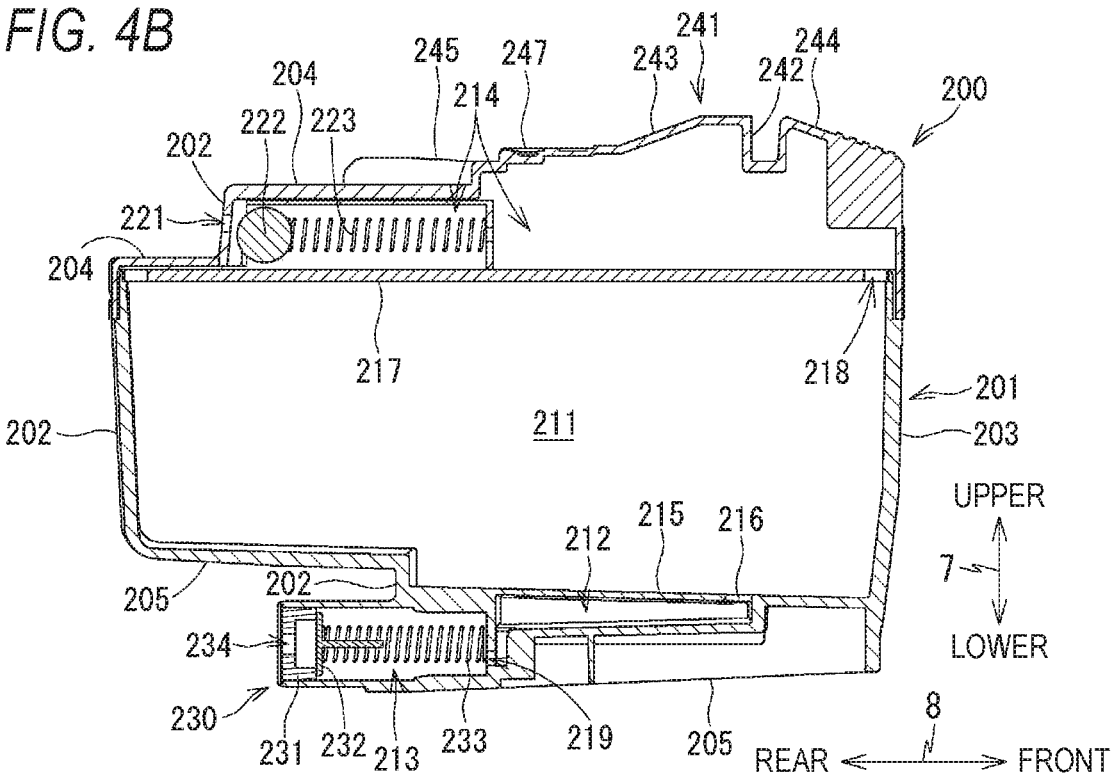

As shown in FIG. 4B, in the internal space of the cartridge 200, the liquid chamber 210, an ink valve chamber 213, and an atmosphere valve chamber 214 are formed. The liquid chamber 210 includes an upper liquid chamber 211 and a lower liquid chamber 212. The upper liquid chamber 211, the lower liquid chamber 212, and the atmosphere valve chamber 214 are an internal space of the housing 201. In the meantime, the ink valve chamber 213 is an internal space of the supply pipe 230. In the liquid chamber 210, the ink is stored. The atmosphere valve chamber 214 is configured to cause the liquid chamber 210 and the outside of the cartridge 200 to communicate with each other. The liquid chamber 210 is an example of the first liquid chamber.

The upper liquid chamber 211 and the lower liquid chamber 212 of the liquid chamber 210 are spaced in the upper and lower direction 7 by a partition wall 215 configured to partition the internal space of the housing 201. The upper liquid chamber 211 and the lower liquid chamber 212 are configured to communicate with each other via a through-hole 216 formed in the partition wall 215. Also, the upper liquid chamber 211 and the atmosphere valve chamber 214 are spaced in the upper and lower direction 7 by a partition wall 217 configured to partition the internal space of the housing 201. The upper liquid chamber 211 and the atmosphere valve chamber 214 are configured to communicate with each other via a through-hole 218 formed in the partition wall 217. Also, the ink valve chamber 213 is configured to communicate with a lower end of the lower liquid chamber 212 via a through-hole 219.

The atmosphere valve chamber 214 is configured to communicate with the outside of the cartridge 200 through an atmosphere communication port 221 formed in the rear wall 202, at the upper part of the cartridge 200. That is, the atmosphere valve chamber 214 is an example of the second flow path of which one end (the through-hole 218) is configured to communicate with the liquid chamber 210 (more specifically, the upper liquid chamber 211) and the other end (the atmosphere communication port 221) is configured to communicate with the outside of the cartridge 200. In the meantime, the atmosphere valve chamber 214 is configured to communicate with the atmosphere through the atmosphere communication port 221. Also, in the atmosphere valve chamber 214, a valve 222 and a coil spring 223 are positioned. The valve 222 can be moved in the front and rear direction 8 between a closed position and an opened position. The valve 222 is configured to close the atmosphere communication port 221 at the closed position. Also, the valve 222 is configured to open the atmosphere communication port 221 at the opened position. The coil spring 223 is configured to urge the valve 222 in a direction of moving the same from the opened position toward the closed position, i.e., rearward in the front and rear direction 8.

While the cartridge 200 is being installed in the installation case 150, the rod 153 is introduced into the atmosphere valve chamber 214 through the atmosphere communication port 221. The rod 153 introduced into the atmosphere valve chamber 214 moves forward the valve 222 located at the closed position against the urging force of the coil spring 223. The valve 222 is moved to the opened position, so that the upper liquid chamber 211 communicates with the atmosphere. In the meantime, the configuration for opening the atmosphere communication port 221 is not limited to the above example. As another example, the rod 153 may be configured to tear off a film for sealing the atmosphere communication port 221.

The supply pipe 230 protrudes rearward from the rear wall 202, at the lower part of the housing 201. A protruding end (i.e., a rear end) of the supply pipe 230 is opened. That is, the ink valve chamber 213 is configured to cause the liquid chamber 210, which communicates with the ink valve chamber 213 through the through-hole 219, and the outside of the cartridge 200 to communicate with each other. The ink valve chamber 213 is an example of the first flow path of which one end (the through-hole 219) is configured to communicate with the liquid chamber 210 (more specifically, the lower liquid chamber 212) and the other end (an ink supply port 234, which will be described later) is configured to communicate with the outside of the cartridge 200. Also, in the ink valve chamber 213, a packing 231, a valve 232 and a coil spring 233 are positioned.

The packing 231 is formed at its center with an ink supply port 234 penetrating the packing in the front and rear direction 8. An inner diameter of the ink supply port 234 is slightly smaller than an outer diameter of the needle 181. The valve 232 can be moved in the front and rear direction 8 between a closed position and an opened position. The valve 232 is configured to contact the packing 231 and to close the ink supply port 234 at the closed position. Also, the valve 232 is configured to separate from the packing 231 and to open the ink supply port 234 at the opened position. The coil spring 233 is configured to urge the valve 232 in a direction of moving the same from the opened position toward the closed position, i.e., rearward in the front and rear direction 8. Also, the urging force of the coil spring 233 is greater than the coil spring 186.

While the cartridge 200 is being installed in the installation case 150, the supply pipe 230 is introduced into the guide 182, so that the needle 181 is introduced into the ink valve chamber 213 through the ink supply port 234. At this time, the needle 181 elastically deforms the packing 231 and is liquid-tightly contacted to an inner peripheral surface demarcating the ink supply port 234. When the cartridge 200 is further inserted into the installation case 150, the needle 181 moves forward the valve 232 against the urging force of the coil spring 233. Also, the valve 232 moves rearward the valve 185 protruding from the opening 183 of the needle 181 against the urging force of the coil spring 186.

Figure 5:
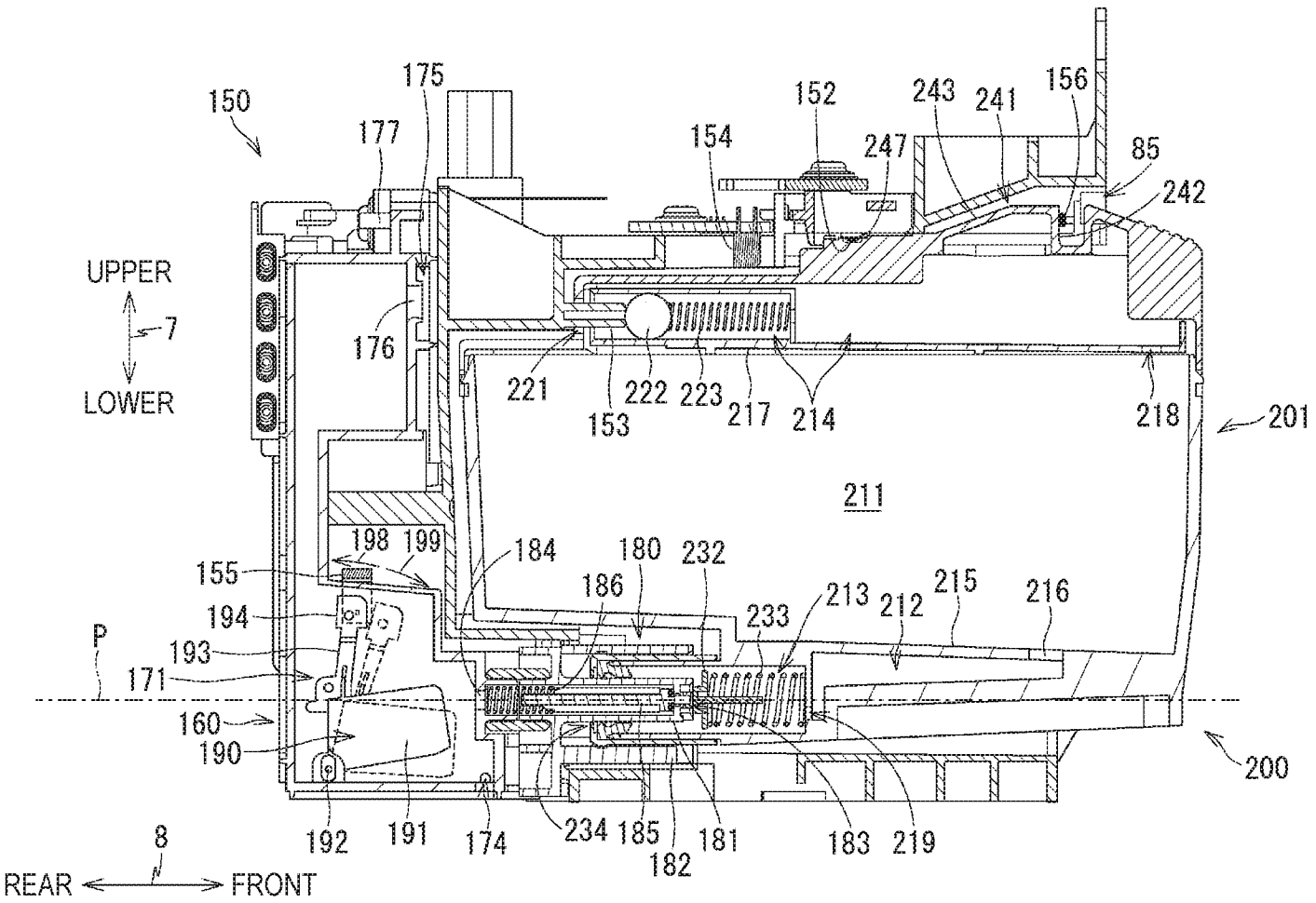
FIG. 5 is a longitudinal sectional view depicting a state where the cartridge 200 is installed in the installation case 150.

Thereby, as shown in FIG. 5, the ink supply port 234 and the opening 183 are opened, so that the ink valve chamber 213 of the supply pipe 230 and the internal space of the needle 181 communicate with each other. That is, in the state where the cartridge 200 is installed in the installation case 150, the ink valve chamber 213 and the internal space of the needle 181 configure a flow path for causing the liquid chamber 210 of the cartridge 200 and the liquid chamber 171 of the tank 160 to communicate with each other.

Incidentally, the ink supply port 234 may be provided on the surface of the rear wall 202 of the cartridge 200, and an internal space (e.g., through hole) formed in a thickness direction of the rear wall 202 may configure the first flow path. In such a modified example, when the cartridge 200 is installed in the installation case 150, the needle 181 is introduced into the first flow path through the ink supply port 234, so that the one end (the opening 183) of the needle 181 communicates with the liquid chamber 210 of the cartridge 200.

Alternatively, the opening 183 may be provided on the surface of the front wall 162 of the tank 160, and an internal space (e.g., through hole) formed in a thickness direction of the front wall 162 may configure the third flow path. In such a modified example, when the cartridge 200 is installed in the installation case 150, the supply pipe 230 is introduced into the third flow path through the opening 183, so that the other end (ink supply port 234) of the ink valve chamber 213 communicates with the liquid chamber 171 of the tank 160.

Also, in the state where the cartridge 200 is installed in the installation case 150, a part of the liquid chamber 210 and a part of the liquid chamber 171 are overlapped, as seen from the horizontal direction. As a result, the ink stored in the liquid chamber 210 is moved to the liquid chamber 171 of the tank 160 through the supply pipe 230 and the joint 180 by the water head difference.

The upper wall 204 is formed with a protrusion 241. The protrusion 241 protrudes upward from an outer surface of the upper wall 204 and extends in the front and rear direction 8. The protrusion 241 has a lock surface 242 and an inclined surface 243. The lock surface 242 and the inclined surface 243 are located above the upper wall 204. The lock surface 242 faces forward in the front and rear direction 8 and extends in the upper and lower direction 7 and in the right and left direction 9 (i.e., the lock surface is substantially perpendicular to the upper wall 204). The inclined surface 243 is inclined relative to the upper wall 204 so as to face upward in the upper and lower direction 7 and rearward in the front and rear direction 8.

The lock surface 242 is a surface that is contacted to the lock pin 156 in the state where the cartridge 200 is installed in the installation case 150. The inclined surface 243 is a surface configured to guide the lock pin 156 to a position at which it is contacted to the lock surface 242 while the cartridge 200 is being installed in the installation case 150. In a state where the lock surface 242 and the lock pin 156 are in contact with each other, the cartridge 200 is kept at the installation position shown in FIG. 5 against the urging forces of the coil springs 186, 223, 233.

In front of the lock surface 242, a flat plate-shaped member extends upward from the upper wall 204. An upper surface of the flat plate-shaped member is configured as an operation part 244 that is to be operated by a user when removing the cartridge 200 from the installation case 150. In the state where the cartridge 200 is installed in the installation case 150 and the cover 87 is located at the exposed position, the operation part 244 can be operated by the user. When the operation part 244 is pushed downward, the cartridge 200 is rotated, so that the lock surface 242 is moved more downward than the lock pin 156. As a result, the cartridge 200 can be removed from the installation case 150.

A light shield rib 245 is formed at the rear of the protrusion 241 on the outer surface of the upper wall 204. The light shield rib 245 protrudes upward from the outer surface of the upper wall 204 and extends in the front and rear direction 8. The light shield rib 245 is formed of a material or color capable of shielding the light to be emitted from the light emitting unit of the mounting sensor 154. The light shield rib 245 is positioned on a light path from the light emitting unit to the light receiving unit of the mounting sensor 154 in the state where the cartridge 200 is installed in the installation case 150. That is, the mounting sensor 154 is configured to output a low level signal to the controller 130 in the state where the cartridge 200 is installed in the installation case 150. On the other hand, the mounting sensor 154 is configured to output a high level signal to the controller 130 in a state where the cartridge 200 is not installed in the installation case 150. That is, the controller 130 can detect whether the cartridge 200 is installed in the installation case 150, based on the signal to be output from the mounting sensor 154.

An IC chip 247 is positioned between the light shield rib 245 and the protrusion 241 in the front and rear direction 8 on the outer surface of the upper wall 204. The IC chip 247 is formed with electrodes 248. Also, the IC chip 247 has a memory (not shown). The electrodes 248 are electrically connected to the memory of the IC chip 247. The electrodes 248 are exposed on an upper surface of the IC chip 247 so that they can be conductively connected to the contact 152. That is, in the state where the cartridge 200 is installed in the installation case 150, the electrodes 248 are electrically conductive to the contact 152. The controller 130 can read out information from the memory of the IC chip 247 through the contact 152 and the electrodes 248, and write information to the memory of the IC chip 247 through the contact 152 and the electrodes 248. Incidentally, the interface of the installation case 150 may be configured by a wireless interface, and the IC chip 247 may be formed with a wireless interface. The wireless interface of the IC chip 247 may be electrically connected to the memory of the IC chip 247. The wireless interface of the IC chip 247 may be communicable with the wireless interface of the installation case 150 wirelessly, in the state where the cartridge 200 is installed in the installation case 150, for example. The controller 130 may read-out/write information from/to the memory of the IC chip 247 via the wireless interface of the IC chip 247 and the wireless interface of the installation case 150.

In the memory of the IC chip 247, a maximum ink amount Vc0, a viscosity ρ, and an ink amount Vc, a height Hc, a flow path resistance Rc and the function Fc, which will be described later, are stored. The memory of the IC chip 247 is an example of the cartridge memory. The maximum ink amount Vc0 is an example of the maximum liquid amount indicative of a maximum amount of the ink that can be stored in the cartridge 200. In other words, the ink amount Vc0 indicates an amount of the ink stored in the brand-new cartridge 200. The viscosity p indicates a viscosity of the ink stored in the cartridge 200. In the below, the information stored in the memory of the IC chip 247 may be collectively referred to as "CTG information". Also, the "brand-new cartridge" indicates a state where the ink in the cartridge 200 has never been discharged from the cartridge 200.

A storage region of the memory of the IC chip 247 includes a first region, a second region, and a third region, for example. The first region, the second region, and the third region are different memory regions. The first region and the third region are regions in which information is not overwritten by the controller 130. On the other hand, the second region is a region in which information can be overwritten by the controller 130. The flow path resistance Rc and the function Fc are stored in the first region, the ink amount Vc and the height Hc are stored in the second region, and the maximum liquid amount Vc0 is stored in the third region.

(Controller 130)

As shown in FIG. 6, the controller 130 includes a CPU 131, a ROM 132, a RAM 133, an EEPROM 134, and an ASIC 135. In the ROM 132, a program and the like by which the CPU 131 is to control diverse operations are stored. The RAM 133 is used as a storage area in which data, signals and the like, which are to be used when the CPU 131 executes the program, are temporarily stored, or a work area of data processing. In the EEPROM 134, setting information that should be kept even after a power supply becomes off is stored. The ROM 132, the RAM 133, and the EEPROM 134 are examples of the apparatus memory.

The ASIC 135 is to operate the feeder roller 23, the conveyer rollers 25, the discharge rollers 27, and the head 21. The controller 130 is configured to rotate the feeder roller 23, the conveyer rollers 25 and the discharge rollers 27 by driving a motor (not shown) through the ASIC 135. Also, the controller 130 is configured to enable the head 21 to discharge the ink through the nozzles 29 by outputting a drive signal to a drive element of the head 21 through the ASIC 135. The ASIC 135 can output a plurality of types of drive signals, in correspondence to an amount of the ink to be discharged through the nozzles 29.

Also, the ASIC 135 is connected with a display 17 and an operation panel 22. The display 17 is a liquid crystal monitor, an organic EL display or the like, and has a display surface for displaying diverse information. The display 17 is an example of the notification device. However, the specific example of the notification device is not limited to the display 17, and may be a speaker, an LED lamp or a combination thereof. The operation panel 22 is configured to output an operation signal corresponding to a user's operation to the controller 130. The operation panel 22 may have a push button and a touch sensor superimposed on the display, for example.

Also, the ASIC 135 is electrically connected with the contacts 152, the cover sensor 88, the mounting sensors 154, and the liquid level sensors 155. The controller 130 is configured to access the memory of the IC chip 247 of the cartridge 200 installed in the installation case 150, through the contact 152. The controller 130 is configured to detect a position of the cover 87 through the cover sensor 88. Also, the controller 130 is configured to detect whether the cartridge 200 is inserted or removed, through the mounting sensor 154. Also, the controller 130 is configured to detect whether the liquid level of the ink in the liquid chamber 171 is equal to or higher than the boundary position P, through the liquid level sensor 155.

In the EEPROM 134, a variety of information is stored with being associated with each of the four cartridges 200 to be installed in the installation case 150, i.e., with being associated with each of the tanks 160 configured to communicate with the cartridges 200. The variety of information includes ink amounts Vc, Vs, which are examples of the liquid amount, the maximum ink amount Vc0, heights Hc, Hs, flow path resistances Rc, Rs, Rn, functions Fc, Fs, a C_Empty flag, an S_Empty flag, and a count value N, for example.

In the meantime, the maximum ink amount Vc0, the ink amount Vc, the height Hc, the flow path resistance Rc, and the function Fc are information that is to be read out from the memory of the IC chip 247 through the contact 152 by the controller 130 in the state where the cartridge 200 is installed in the installation case 150. Also, the flow path resistances Rc, Rn and the function Fs may be stored in the ROM 132, instead of the EEPROM 134.

The ink amount Vc indicates an amount of the ink stored in the liquid chamber 210 of the cartridge 200. The ink amount Vs indicates an amount of the ink stored in the liquid chamber 171 of the tank 160. The ink amounts Vc, Vs are calculated by equations 3 and 4, which will be described later, for example.

The height Hc indicates a height of the liquid level of the ink stored in the cartridge 200 from a reference position in the upper and lower direction. The height Hs indicates a height of the liquid level of the ink stored in the tank 160 from the reference position in the upper and lower direction. As an example, the reference position may by a position on a virtual line passing through a center of the internal space of the needle 181 and extending in the horizontal direction (more specifically, the front and rear direction 8). As another example, the reference position may be the same as the boundary position P. The heights Hc, Hs are calculated by equations 5 and 6, which will be described later, for example.

The flow path resistance Rc indicates a magnitude of a resistance received by air passing through the atmosphere valve chamber 214. More specifically, the flow path resistance Rc indicates a resistance when the air passes through a semipermeable film positioned on a flow path from the atmosphere communication port 221 to the through-hole 218. The flow path resistance Rs indicates a magnitude of a resistance received by air passing through the atmosphere communication chamber 175. More specifically, the flow path resistance Rs indicates a resistance when the air passes through a semipermeable film positioned on a flow path from the atmosphere communication port 177 to the through-hole 176. The flow path resistance Ra indicates a magnitude of a resistance received by the ink passing through the ink valve chamber 213 and the internal space of the needle 181 communicating with each other. More specifically, the flow path resistance Ra indicates one or both of a magnitude of a resistance received by the ink passing through the ink valve chamber 213 and a magnitude of a resistance received by the ink passing through the internal space of the needle 181.

The function Fc is an example of the first correspondence information indicative of a correspondence relation between the ink amount Vc and the height Hc. In case that a horizontal sectional area Dc of the liquid chamber 210 of the cartridge 200 changes in the upper and lower direction 7, the function Fc is preset upon design of the cartridge 200 by using the ink amount Vc and the height Hc as variables. On the other hand, in case that the horizontal sectional area Dc is constant in the upper and lower direction 7, the function Fc=Vc/Dc. The first correspondence information is not limited to the type of the function, and may be a table type including a plurality of sets of the ink amounts Vc and the heights Hc corresponding to each other.

The function Fs is an example of the second correspondence information indicative of a correspondence relation between the ink amount Vs and the height Hs. In case that a horizontal sectional area Ds of the liquid chamber 171 of the tank 160 changes in the upper and lower direction 7, the function Fs is preset upon design of the tank 160 by using the ink amount Vs and the height Hc as variables. On the other hand, in case that the horizontal sectional area Ds is constant in the upper and lower direction 7, the function Fs=Vs/Ds. In the meantime, the second correspondence information is not limited to the type of the function, and may be a table type including a plurality of sets of the ink amounts Vs and the heights Hc corresponding to each other.

The count value N is a value corresponding to an ink discharge amount Dh (i.e., an ink amount indicated by a drive signal) of which discharge through the head 21 is instructed, after the signal output from the liquid level sensor 155 changes from the low level signal to the high level signal, and is a value that is to be updated to be close to a threshold value $N_{th}$. The count value N is a value that is to be counted up from an initial value "0". Also, the threshold value $N_{th}$ corresponds to a volume $V_{th}$ of the liquid chamber 171 between the upper end of the outflow port 174 and the boundary position P. The volume $V_{th}$ is an example of the threshold amount. On the other hand, the count value N may be a value that is to be counted down from an initial value corresponding to the volume $V_{th}$. In this case, the threshold value $N_{th}$ is 0.

The C_Empty flag is information indicative of whether the cartridge 200 is in a cartridge empty state. For the C_Empty flag, a value "ON" corresponding to a case where the cartridge is in the cartridge empty state or a value "OFF" corresponding to a case where the cartridge is not in the cartridge empty state is set. The cartridge empty state is a state where the ink is not substantially stored in the cartridge 200 (more specifically, the liquid chamber 210). That is, the cartridge empty state is a state where the ink is not moved from the cartridge 200 to the tank 160 communicating with each other. In other words, the cartridge empty state is a state where the liquid level of the tank 160 communicating with the cartridge 200 is lower than the boundary position P.

The S_Empty flag is information indicative of whether the tank 160 is in an ink empty state. For the S_Empty flag, a value "ON" corresponding to a case where the tank is in the ink empty state or a value "OFF" corresponding to a case where the tank is not in the ink empty state is set. The ink empty state is a state where the liquid level of the ink stored in the tank 160 (more specifically, the liquid chamber 171) reaches the upper end of the outflow port 174. In other words, the ink empty state is a state where the count value N is equal to or larger than the threshold value $N_{th}$. When the ink is continuously discharged by the head 21 after the ink empty state, the nozzles 29 may not be filled with the ink and the air may be instead mixed in the nozzles 29 (so-called, air-in). That is, the ink empty state is a state where the discharge of the ink through the head 21 should be prohibited.

(Operations of Printer 10)

Figure 7:
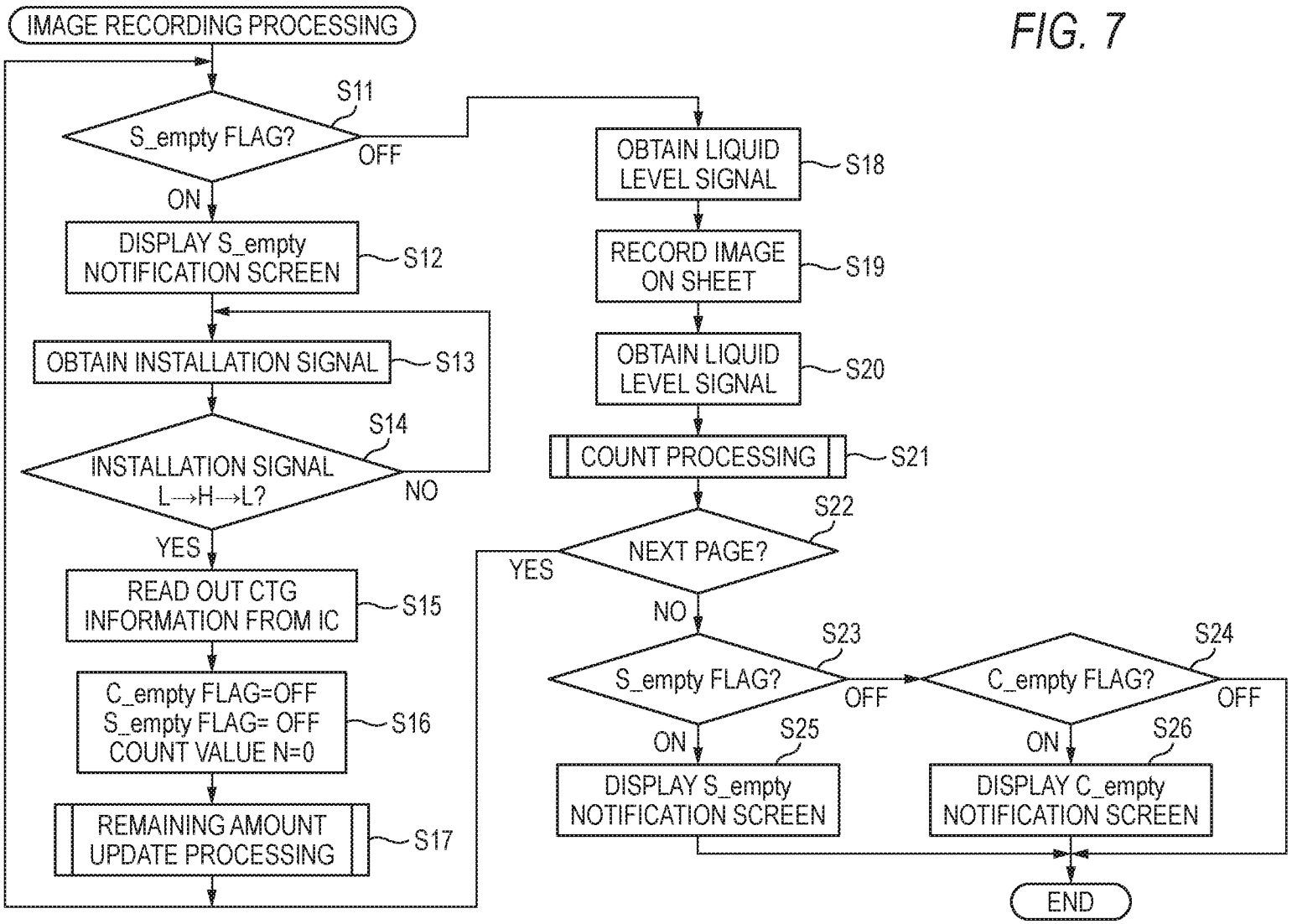
FIG. 7 is a flowchart of image recording processing.
Figure 8:
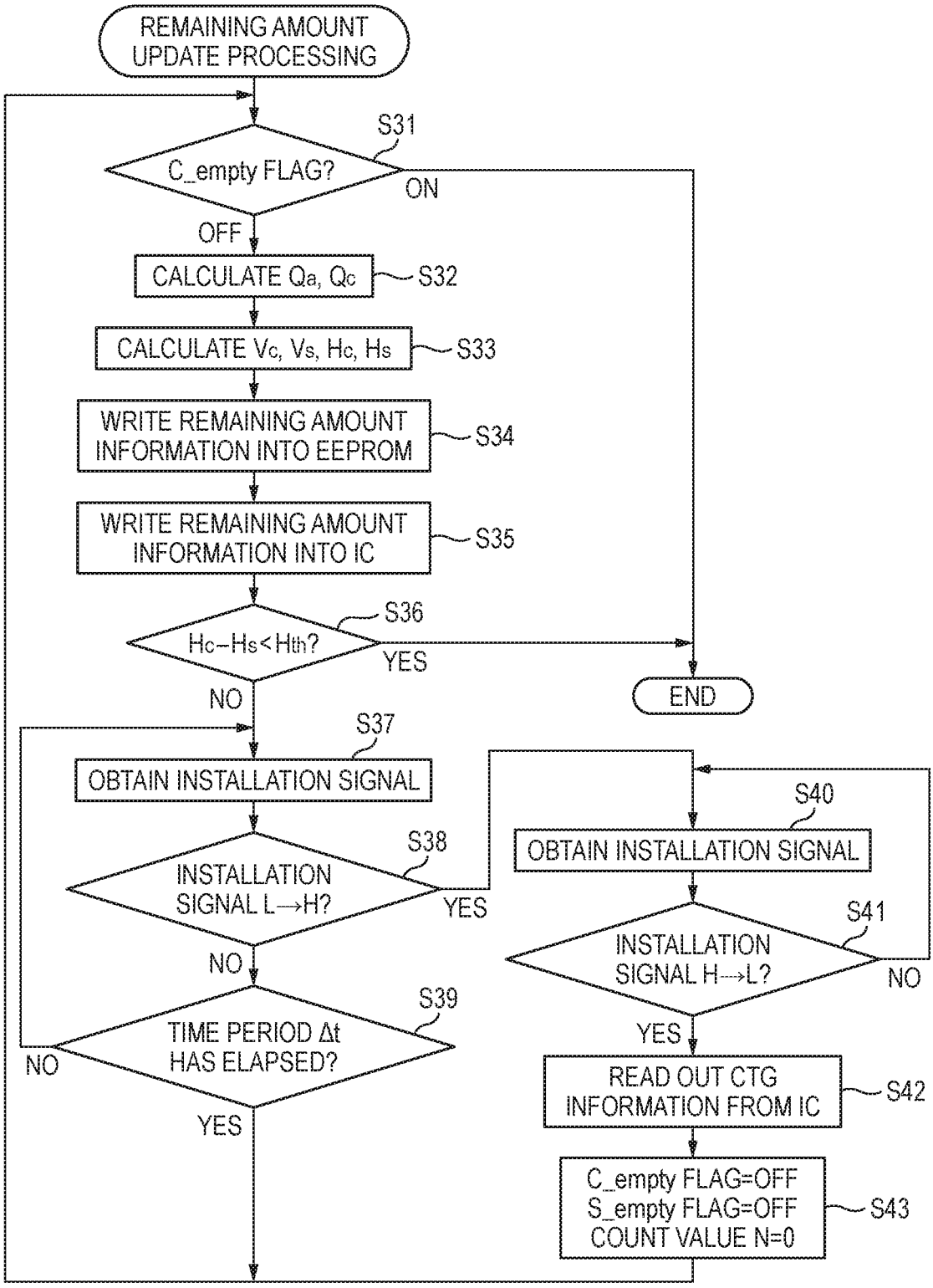
FIG. 8 is a flowchart of remaining amount update processing.
Figure 9:
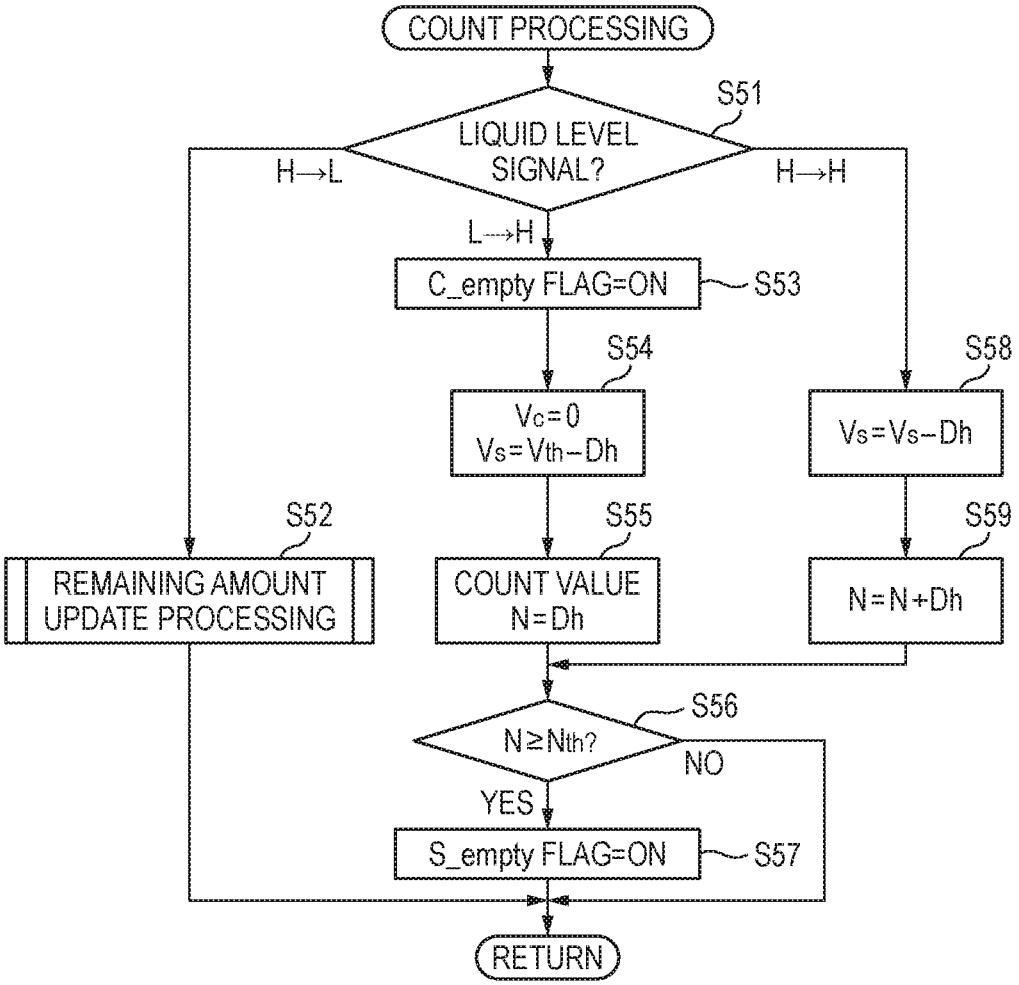
FIG. 9 is a flowchart of count processing.

The operations of the printer 10 in accordance with the illustrative embodiment are described with reference to FIGS. 7 to 9. The respective processing shown in FIGS. 7 to 9 is executed by the CPU 131 of the controller 130. The respective processing to be described later may be executed by the CPU 131 reading out the program stored in the ROM 132 or may be implemented by a hardware circuit installed on the controller 130. Also, an execution sequence of the respective processing can be appropriately changed without departing from the gist of the disclosure.

(Image Recording Processing)

When a recording instruction is input to the printer 10, the controller 130 executes image recording processing shown in FIG. 7. The recording instruction is an example of the discharge instruction for enabling the printer 10 to execute recording processing of recording an image, which is to be expressed by image data, onto a sheet. An obtaining source of the recording instruction is not particularly limited. For example, a user operation corresponding to the recording instruction may be received through the operation panel 22 or may be received from an external apparatus via a communication interface (not shown).

First, the controller 130 determines the setting values of the four S_Empty flags (S11). When it is determined that the value "ON" is set for at least one of the four S_Empty flags (S11: ON), the controller 130 displays an S_Empty notification screen on the display 17 (S12). The S_Empty notification screen is a screen for notifying the user that the corresponding tank 160 is in the ink empty state. The S_Empty notification screen may include information indicative of a color of the ink stored in the tank 160 in the ink empty state and the ink amounts Vc, Vs, for example.

Also, the controller 130 executes processing of S13 to S17 for each of the cartridges 200 corresponding to the S_Empty flags having the value "ON" set thereto. That is, the processing of S13 to S17 is executed for each of the cartridges 200, for which the value "ON" is set to the corresponding S_Empty flag, of the four cartridges 200. Since the processing of S13 to S17 that is executed for each cartridge 200 is common, only the processing of S13 to S17 corresponding to one cartridge 200 is described.

First, the controller 130 obtains a signal output from the mounting sensor 154 (S13). Then, the controller 130 determines whether the signal obtained from the mounting sensor 154 is a high level signal or a low level signal (S14). The controller 130 repeatedly executes the processing of S13 and S14 with predetermined time intervals until the signal output from the mounting sensor 154 changes from the low level signal to the high level signal and again changes from the high level signal to the low level signal (S14: No). In other words, the controller 130 repeatedly executes the processing of S13 and S14 until the cartridge 200 is removed from the installation case 150 and a new cartridge 200 is installed in the installation case 150.

Then, when the controller 130 obtains the low level signal from the mounting sensor 154, obtains the high level signal from the mounting sensor 154 and then obtains the low level signal from the mounting sensor 154 (S14: Yes), the controller 130 executes processing of S15 to S17. First, the controller 130 reads out the CTG information from the memory of the IC chip 247 through the contact 152, and stores the read CTG information in the EEPROM 134 (S15). Also, the controller 130 assigns the initial value "OFF" to the C_Empty flag, assigns the initial value "OFF" to the S_Empty flag, and assigns the initial value "0" to the count value N (S16).

Further, the controller 130 executes remaining amount update processing (S17). The remaining amount update processing is processing of updating the ink amounts Vc, Vs and the heights Hc, Hs stored in the EEPROM 134. The remaining amount update processing will be described later in detail with reference to FIG. 8. Also, although described later in detail, the controller 130 again executes the processing of S11 and thereafter in parallel with the remaining amount update processing or when the remaining amount update processing is over. When it is determined that the value "OFF" is set for all of the four S_Empty flags (S11: OFF), the controller 130 obtains signals that are currently output from the four liquid level sensors 155 (S18). Also, in S18, the controller 130 stores, in the RAM 133, information indicative of whether the signal obtained from each of the liquid level sensors 155 is the high level signal or the low level signal.

Then, the controller 130 records an image, which is expressed by image data included in the recording instruction, on the sheet (S19). More specifically, the controller 130 enables the feeder roller 23 and the conveyer rollers 25 to convey the sheet on the feeder tray 15, the head 21 to discharge the inks, and the discharge rollers 27 to discharge the sheet having an image recorded thereon to the discharge tray 16. That is, the controller 130 permits the discharge of the inks when the value "OFF" is set for all of the four S_Empty flags. On the other hand, the controller 130 prohibits the discharge of the inks when the value "ON" is set for at least one of the four S_Empty flags.

Then, when the image is recorded on the sheet in accordance with the recording instruction, the controller 130 obtains the signals that are currently output from each of the four liquid level sensors 155 (S20). In S20, like S18, the controller 130 stores, in the RAM 133, the information indicative of whether the signal obtained from each of the liquid level sensors 155 is the high level signal or the low level signal. Then, the controller 130 executes count processing (S21). The count processing is processing of updating the count value N, the C_Empty flag, and the S_Empty flag on the basis of the signals obtained from the liquid level sensors 155 in S18 and S20. The count processing will be described later in detail with reference to FIG. 9.

Then, the controller 130 repeatedly executes the processing of S11 to S21 until all images indicated by the recording instruction are recorded on the sheet (S22: Yes). When all images indicated by the recording instruction are recorded on the sheet (S22: No), the controller 130 determines the setting values of the four S_Empty flags and the setting values of the C_Empty flags (S23, S24).

When the value "ON" is set for at least one of the four S_Empty flags (S23: ON), the controller 130 displays the S_Empty notification screen on the display 17 (S25). Also, when the value "OFF" is set for all of the four S_Empty flags and the value "ON" is set for at least one of the four C_Empty flags (S23: OFF&S24: ON), the controller 130 displays a C_Empty notification screen on the display 17 (S26). The processing of S25 and S26 is an example of the processing of operating the notification device.

The S_Empty notification screen that is displayed in S25 may be similar to the S_Empty notification screen in S12. Also, the C_Empty notification screen is a screen for notifying the user that the cartridge 200 corresponding to the C_Empty flag having the value "ON" set thereto is in the cartridge empty state. The C_Empty notification screen may include information indicative of a color of the ink stored in the cartridge 200 in the cartridge empty state and the ink amounts Vc, Vs, for example. On the other hand, when the value "OFF" is set for all of the four S_Empty flags and all of the four C_Empty flags (S24: OFF), the controller 130 ends the image recording processing without executing the processing of S25 and S26.

In the meantime, the specific example of the discharge instruction is not limited to the recording instruction, and may be a maintenance instruction for instructing maintenance of the nozzles 29, and the like. When the maintenance instruction is obtained, for example, the controller 130 executes processing similar to FIG. 7. A difference between the processing that is executed when the maintenance instruction is obtained and the above processing is described. First, in S19, the controller 130 drives a maintenance mechanism (not shown) to discharge the ink through the nozzles 29. Also, after executing the count processing, the controller 130 executes the processing of S23 and thereafter, without executing the processing of S22.

(Remaining Amount Update Processing)

Figure 10A:
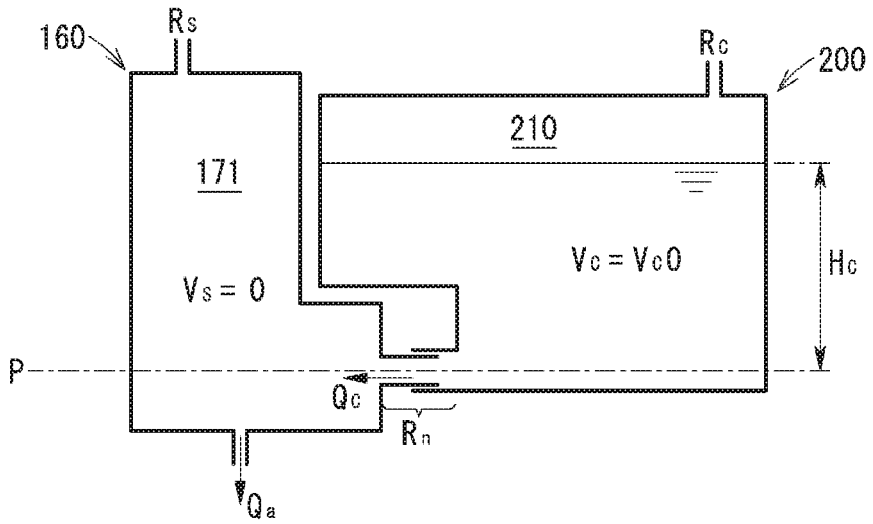

Subsequently, the remaining amount update processing that is executed in S17 by the controller 130 is described in detail with reference to FIG. 8. In the meantime, as shown in FIG. 10A, it is presumed that a brand-new cartridge 200 (i.e., the maximum ink amount Vc0 of the ink is stored) is installed in the installation case 150 where the ink is not stored in the tank 160. Also, it is assumed that the remaining amount update processing is executed at time $t_k$ after a time period Δt from time $t_{k-1}$ at which it is newly detected in S14 that the cartridge 200 is installed. That is, in this case, the time period $\Delta t = t_k - t_{k-1}$.

First, the controller 130 determines the setting value of the corresponding C_Empty flag (S31). Upon the start of the remaining amount update processing that is executed in S17, the value "OFF" has been set for the C_Empty flag in S16. Then, when it is determined that the value "OFF" is set for the C_Empty flag (S31: OFF), the controller 130 calculates outflow amounts Qa, Qc, the ink amounts Vc, Vs, and the heights Hc, Hs by using equations 1 to 6 (S32, S33).

First, the outflow amount Qa indicates an amount of ink that is to flow out from the liquid chamber 171 through the outflow port 174 for the time period Δt. Since the ink is not discharged through the head 21 upon the execution of S12 to S17, the ink discharge amounts $Dh(t_{k-1})$, $Dh(t_k)$ are all zero. That is, the controller 130 calculates the outflow amount Qa=0 by using the equation 1 (S32).

$$Q_a = Dh(t_k) - Dh(t_{k-1}) \quad \text{(equation 1)}$$

The outflow amount Qc indicates an amount of ink that is to flow out from the liquid chamber 210 to the liquid chamber 171 through the internal space of the needle 181 and the ink valve chamber 213 communicating with each other for the time period Δt. The controller 130 reads out the heights Hc, Hs stored in the EEPROM 134, as height Hc', Hs' at time $t_{k-1}$. Also, the controller 130 reads out the viscosity p and the flow path resistances Rc, Rs, Rn from the EEPROM 134. Then, the controller 130 assigns the information read out from the EEPROM 134, the gravity acceleration g and the outflow amount Qa=0 calculated at the last minute to an equation 2, thereby calculating the outflow amount Qc (S32).

$$Q_c = \frac{(H'_c - H'_s) \times g \times \rho + Q_a \times R_S}{R_c + R_s + R_n} \quad \text{(equation 2)}$$

As shown in the equation 2, the outflow amount Qc increases as a difference (i.e., a water head difference) between the heights Hc', Hs' increases, and decreases as the water head difference decreases. Also, the outflow amount Qc decreases as the flow path resistance Rn of the ink valve chamber 213 and the internal space of the needle 181, through which the ink is to actually pass, increases, and increases as the flow path resistance Rn decreases.

Also, when the ink moves from the liquid chamber 210 to the liquid chamber 171, the liquid chamber 210 is temporarily decompressed from the atmospheric pressure, and the liquid chamber 171 is temporarily compressed beyond the atmospheric pressure. A pressure difference between the pressure in the liquid chamber 210 and the atmospheric pressure is solved as the air is introduced into the liquid chamber 210 through the atmosphere valve chamber 214. Also, in the case of the outflow amount Qa=0, a pressure difference between the pressure in the liquid chamber 171 and the atmospheric pressure is solved as the air flows out from the liquid chamber 171 through the atmosphere communication chamber 175.

The above pressure differences hinder the ink from moving from the liquid chamber 210 toward the liquid chamber 171. That is, the outflow amount Qc decreases as the flow path resistance Rc increases, and increases as the flow path resistance Rc decreases. Also, in the case of the outflow amount Qa=0, the outflow amount Qc decreases as the flow path resistance Rs increases, and increases as the flow path resistance Rs decreases.

Then, the controller 130 reads out the ink amount Vc stored in the EEPROM 134, as an ink amount Vc' at time $t_{k-1}$. Then, the controller 130 assigns the ink amount Vc' read out from the EEPROM 134 and the outflow amount Qc calculated at the last minute to an equation 3, thereby calculating the ink amount Vc at time $t_k$ (S33). That is, the controller 130 subtracts the outflow amount Qc of the ink, which has flowed out from the liquid chamber 210 to the liquid chamber 171 for the time period Δt, from the ink amount Vc' at time $t_{k-1}$, thereby calculating the ink amount Vc at time $t_k$.

$$V_c = V'_c - Q_c \quad \text{(equation 3)}$$

Also, in S33, the controller 130 reads out the ink amount Vs stored in the EEPROM 134, as an ink amount Vs' at time $t_{k-1}$. Then, the controller 130 assigns the ink amount Vs' read out from the EEPROM 134 and the outflow amounts Qa, Qc calculated at the last minute to an equation 4, thereby calculating the ink amount Vs at time $t_k$. That is, the controller 130 subtracts the outflow amount Qa of the ink, which has flowed out from the tank 160 for the time period Δt, from the ink amount Vs' at time $t_{k-1}$ and adds thereto the outflow amount Qc of the ink, which has flowed from the liquid chamber 210 to the liquid chamber 171 for the time period Δt, thereby calculating the ink amount Vs at time $t_k$.

$$V_S = V'_S - Q_a + Q_c \quad \text{(equation 4)}$$

Figure 10B:
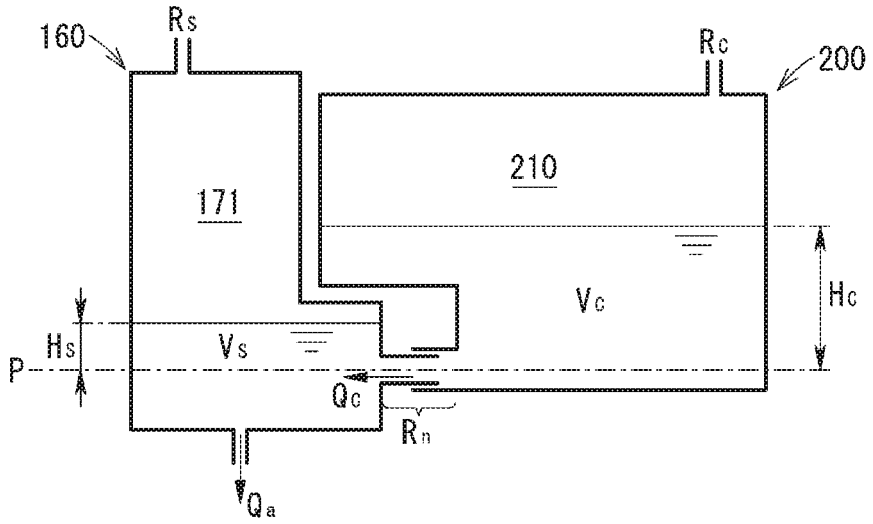
Figure 11A:
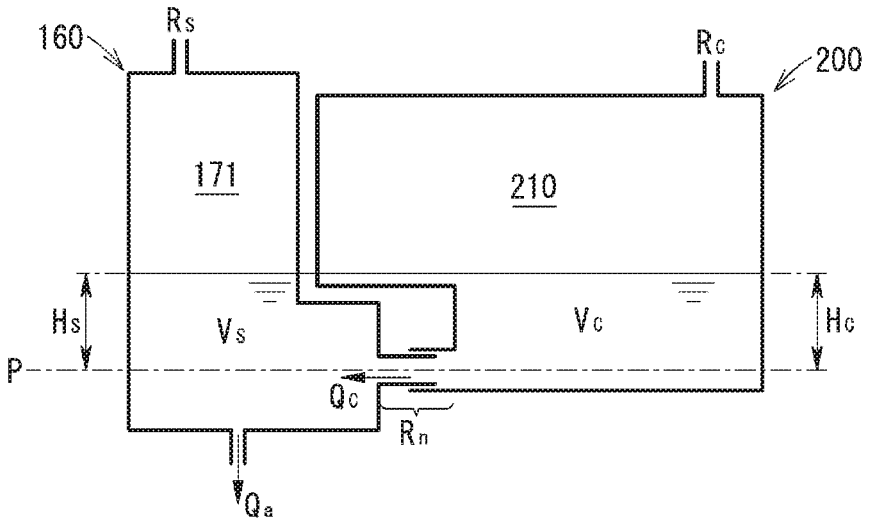

Also, in S33, the controller 130 reads out the function Fc stored in the EEPROM 134. Then, as shown in an equation 5, the controller 130 assigns the ink amount Vc calculated at the last minute to the function Fc, thereby specifying the height Hc at time $t_k$. Also, in S33, the controller 130 compares the ink amount Vc calculated at the last minute and the volume $V_{th}$. When it is determined that the ink amount Vs is equal to or less than the volume $V_{th}$ (i.e., as shown in FIG. 10A, the liquid level of the liquid chamber 171 is equal to or lower than the boundary position P), the controller 130 specifies the height Hs=0 at time $t_k$, as shown in an equation 6. On the other hand, when it is determined that the ink amount Vs is greater than the volume $V_{th}$ (i.e., as shown in FIGS. 10B and 11A, the liquid level of the liquid chamber 171 is higher than the boundary position P), the controller 130 reads out the function Fs from the EEPROM 134. Then, as shown in the equation 6, the controller 130 assigns the ink amount Vs calculated at the last minute to the function Fs, thereby specifying the height Hs at time $t_k$ (S33).

$$H_c = F_c(V_c) \quad \text{(equation 5)}$$

$$H_s = \begin{cases} 0 & (V_s \leqq V_{th}) \\ F_s(V_s) & (V_s > V_{th}) \end{cases} \quad \text{(equation 6)}$$

Then, the controller 130 stores, in the EEPROM 134, the ink amounts Vc, Vs and the heights Hc, Hs calculated in S33 (S34). More specifically, the controller 130 overwrites the ink amounts Vc, Vs and the heights Hc, Hs stored in the EEPROM 134 with the ink amounts Vc, Vs and the heights Hc, Hs calculated in S33 at the last minute. Also, the controller 130 stores the ink amount Vc and the height Hc calculated in S33, in the memory of the IC chip 247 through the contact 152 (S35). More specifically, the controller 130 overwrites the ink amount Vc and the height Hc stored in the second region of the memory of the IC chip 247 with the ink amount Vc and the height Hc calculated in S33 at the last minute.

In the meantime, the controller 130 may obtain the signal output from the cover sensor 88 and determine whether the obtained signal is the high level signal or the low level signal, prior to the processing of S35. When it is determined that the high level signal is obtained from the cover sensor 88, the controller 130 may execute the processing of S35. On the other hand, when it is determined that the low level signal is obtained from the cover sensor 88, the controller 130 may execute the processing of S36 and thereafter, without executing the processing of S35.

Then, the controller 130 compares a difference between the heights Hc, Hs calculated in S33 at the last minute and a threshold height $H_{th}$ (S36). The threshold height $H_{th}$ indicates a water head difference at which it is thought that the ink is not substantially moved between the liquid chambers 210, 171. The threshold height $H_{th}$ is 0 (zero), for example. The state where the ink is not substantially moved between the liquid chambers 210, 171 is referred to as an equivalent state. That is, in the equivalent state, the water head difference between the liquid chambers 210, 171 is substantially 0 (zero).

Then, when it is determined that the difference between the heights Hc, Hs is equal to or greater than the threshold height $H_{th}$ (S36: No), the controller 130 obtains a signal output from the mounting sensor 154 (S37). Then, the controller 130 determines whether the signal obtained from the mounting sensor 154 is the high level signal or the low level signal (S38). The controller 130 repeatedly executes the processing of S37 and S38 with predetermined time intervals shorter than the time period Δt until the signal output from the mounting sensor 154 changes from the low level signal to the high level signal (S38: No) or until the time period Δt elapses after the processing of S32 to S35 is executed at the last minute (S39: No).

Then, when the time period Δt elapses while the output of the mounting sensor 154 is not changed (S38: No&S39: Yes), the controller 130 again executes the processing of S31 and thereafter. In other words, the controller 130 waits for next execution of the processing of S32 to S35 until the time period Δt elapses after the processing of S32 to S35 is executed at the last minute. The processing of S31 to S39 is repeatedly executed, so that the difference between the heights Hc, Hs gradually decreases, as shown in FIGS. 10A to 11A. When it is determined that the difference between the heights Hc, Hs is smaller than the threshold height $H_{th}$ (S36: Yes), the controller 130 ends the remaining amount update processing. That is, the remaining amount update processing corresponding to each of the four cartridges 200 may be over at separate timings.

Herein, the controller 130 may variably set the time period Δt in S39. More specifically, the controller 130 may set the time period Δt in S39 shorter as the difference between the heights Hc, Hs calculated in S33 at the last minute is larger, and may set the time period Δt in S39 longer as the difference between the heights Hc, Hs calculated in S33 at the last minute is smaller. That is, the controller 130 may set the interval (i.e., the update interval of the ink amounts Vc, Vs and the heights Hc, Hs) of the processing of S32 to S35 to be repeatedly executed shorter as the difference between the heights Hc, Hs is larger, and may set the interval longer as the difference between the heights Hc, Hs is smaller.

On the other hand, when it is determined that the output of the mounting sensor 154 changes from the low level signal to the high level signal before the time period Δt elapses (S39: No&S38: Yes), the controller 130 executes processing of S40 to S43, instead of the processing of S31 to S39. The change of the output of the mounting sensor 154 from the low level signal to the high level signal corresponds to a case where the cartridge 200 is removed from the installation case 150. That is, the processing of S32 to S35 is repeatedly executed while the cartridge 200 is installed in the installation case 150, and is stopped when the cartridge 200 is removed from the installation case 150.

Then, the controller 130 repeatedly obtains the signal output from the mounting sensor 154 with predetermined time intervals until the output of the mounting sensor 154 again changes from the high level signal to the low level signal (S41: No) (S40). When the output of the mounting sensor 154 changes from the high level signal to the low level signal (S41: Yes), the controller 130 executes processing of S42 to S43, and again executes the processing of S31 and thereafter. The processing of S37, S38, S40 and S41 corresponds to the processing of S13 and S14 shown in FIG. 7. Also, the processing of S42 and S43 corresponds to the processing of S15 and S16 shown in FIG. 7.

As an example, when the remaining amount update processing having started in S17 is over, the controller 130 may execute the processing of S11 and thereafter. In this case, as shown in FIG. 11A, the discharge of the ink through the head 21 starts in the state in which the liquid levels of the liquid chamber 210, 171 are flush with each other. As another example, the controller 130 may execute the processing of S11 and thereafter in parallel with the remaining amount update processing having started in S17. In this case, as shown in FIG. 10B, the discharge of the ink through the head 21 starts in the state in which the water head difference occurs between the liquid chamber 210, 171.

(Count Processing)

Subsequently, the count processing that is executed in S21 by the controller 130 is described in detail with reference to FIG. 9. In the meantime, the controller 130 independently executes the count processing for each of the four cartridges 200. Since the count processing that is executed for each cartridge 200 is common, only the count processing corresponding to one cartridge 200 is described.

First, the controller 130 compares the information indicative of the signals of the liquid level sensors 155 stored in the RAM 133 in S18 and S20 (S51). That is, the controller 130 determines whether each signal of the four liquid level sensors 155 has changed, before and after executing the processing of S19 immediately before executing the count processing (S21).

When all the information stored in the RAM 133 in S18 and S20 indicates the low level signal (i.e., the output of the liquid level sensor 155 has not changed before and after the processing of S19) (S51:L→L), the controller 130 executes the remaining amount update processing (S52). In the meantime, when the remaining amount update processing starts in S17 and the processing of S19 is executed before the equivalent state, it is not necessary to newly start the remaining amount update processing in S52 because the remaining amount update processing having started in S17 is continuously executed. The remaining amount update processing in S52 is different from the above description, in that the outflow amount Qa≠0. In the below, the description of the common points to the above description is omitted, and different points are mainly described.

First, the controller 130 assigns the ink discharge amount Dh in S19 from start time $t_{k-1}$ to end time $t_k$ to the equation 1, thereby calculating the outflow amount Qa (S32). In this case, the time period Δt corresponds to a time period that is required to record an image to one sheet. Also, in this case, the ink discharge amount Dh corresponds to a total of discharge amounts of the ink that should be discharged to one sheet. That is, the controller 130 may execute the processing of S32 to S35 whenever the image recording of one sheet is terminated. However, the specific examples of the time period Δt and the ink discharge amount Dh are not limited to the above examples.

As another example, the time period Δt corresponds to a time period that is required to record an image of one pass. In this case, time $t_{k-1}$ is time at which the recording of an image of one pass starts. Also, time $t_k$ is time at which the recording of an image of one pass is over. Also, the ink discharge amount $Dh(t_{k-1})$ corresponds to an ink amount of which discharge from start of S19 to time $t_{k-1}$ is instructed. Also, the ink discharge amount $Dh(t_k)$ corresponds to an ink amount of which discharge from start of S19 to time $t_k$ is instructed. That is, the controller 130 may execute the processing of S32 to S35 whenever the image recording of one pass is terminated. As another example, the controller 130 may execute the processing of S32 to S35 at any timing irrelevant to delimitation of the image recording.

Also, the controller 130 assigns the heights Hc', Hs', the viscosity ρ, and the flow path resistances Rc, Rs, Rn stored in the EEPROM 134 and the outflow amount Qa calculated at the last minute to the equation 2, thereby calculating the outflow amount Qc (S32).

The liquid chambers 210, 171 in the equivalent state are all kept at the atmospheric pressure. From this state, when the ink is discharged through the head 21, the ink flows out from the liquid chamber 171 through the outflow port 174. Also, the ink is moved from the liquid chamber 210 to the liquid chamber 171 through the internal space of the needle 181 and the ink valve chamber 213. When the outflow amount Qa increases, the water head difference between the liquid chambers 210, 171 increases. Accordingly, the outflow amount Qc increases as the outflow amount Qa increases.

Also, the liquid chamber 171 is temporarily decompressed from the atmospheric pressure as the ink is discharged through the head 21. The pressure difference between the pressure in the liquid chamber 171 and the atmospheric pressure is solved as the ink is moved from the liquid chamber 210 to the liquid chamber 171 and the air is introduced into the liquid chamber 171 through the atmosphere communication chamber 175. An amount of the air that is introduced into the liquid chamber 171 through the atmosphere communication chamber 175 decreases as the flow path resistance Rs is larger, and increases as the flow path resistance Rs is smaller. The outflow amount Qc upon the outflow amount Qa>0 increases as the flow path resistance Rs is larger, and decreases as the flow path resistance Rs is smaller so as to return the inside of the liquid chamber 171 to the atmospheric pressure.

Figure 11B:
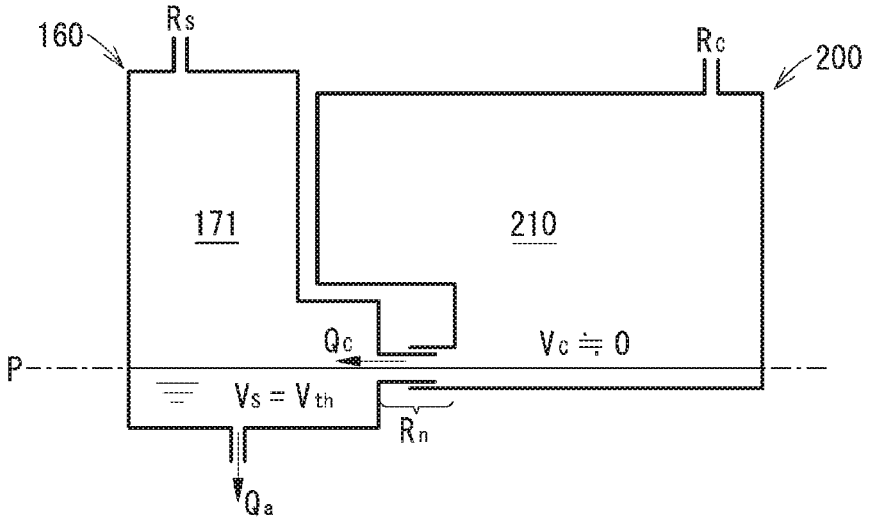

Returning to FIG. 9, when the information stored in the RAM 133 in S18 indicates the low level signal and the information stored in the RAM 133 in S20 indicates the high level signal (i.e., the output of the liquid level sensor 155 has changed before and after the processing of S19) (S51: L→H), the controller 130 assigns the value "ON" to the C_Empty flag (S53). The change of the output of the liquid level sensor 155 from the low level signal to the high level signal corresponds to a case where the liquid level of the liquid chamber 171 reaches the boundary position P during the processing of S19, as shown in FIG. 11B. After this, the ink is not moved between the cartridge 200 and the tank 160. Accordingly, as shown in FIG. 8, when the value "ON" is set for the C_Empty flag (S31: ON), the controller 130 ends the remaining amount update processing.

Also, the controller 130 overwrites the ink amount Vc stored in the EEPROM 134 with a preset value (=0) (S54). Likewise, the controller 130 overwrites the ink amount Vs stored in the EEPROM 134 with a preset value (=the volume $V_{th}$−the ink discharge amount Dh) (S54). Since the ink amounts Vc, Vs calculated in the remaining amount update processing include errors, the errors to be accumulated in the ink amounts Vc, Vs increase as the number of repetition times of the processing of S32 to S35 increases. Therefore, the controller 130 assigns preset values to the ink amounts Vc, Vs to reset the accumulated errors at timing at which the output of the liquid level sensor 155 changes from the low level signal to the high level signal.

In the meantime, as described above, the ink discharge amount Dh corresponds to the ink amount that is discharged to one sheet in S19 at the last minute. Meanwhile, the output of the liquid level sensor 155 changes during the processing of S19. That is, the ink amount Vs overwritten in S54 slightly deviates from the amount of the ink stored in the tank 160 upon the change of the output of the liquid level sensor 155. However, since the deviation is small, the ink amount Vs overwritten in S54 is handled as the ink amount Vs upon the change of the output of the liquid level sensor 155.

Also, the controller 130 assigns the ink discharge amount Dh to the count value N stored in the EEPROM 134 (S55). That is, the controller 130 counts up the count value N to a value equivalent to the ink amount of which discharge has been instructed in S19 at the last minute. In other words, the controller 130 starts to update the count value N, in response to the change of the output of the liquid level sensor 155 from the low level signal to the high level signal.

Then, the controller 130 compares the count value N updated in S55 and the threshold value $N_{th}$ (S56). When it is determined that the count value N updated in S55 is smaller than the threshold value $N_{th}$ (S56: No), the controller 130 ends the count processing without executing processing of S57. On the other hand, when it is determined that the count value N updated in S55 is equal to or greater than the threshold value $N_{th}$ (S56: Yes), the controller 130 assigns the value "ON" to the S_Empty flag (S57), and ends the count processing.

Also, when all the information stored in the RAM 133 in S18 and S20 indicates the high level signal (S51:H→H), the controller 130 reads out the ink amount Vs stored in the EEPROM 134. Then, the controller 130 subtracts the ink discharge amount Dh from the read ink amount Vs, and again stores the resultant value in the EEPROM 134 (S58). Also, the controller 130 reads out the count value N stored in the EEPROM 134. Then, the controller 130 adds the ink discharge amount Dh to the read count value N, and again stores the resultant value in the EEPROM 134 (S59). That is, the controller 130 updates the ink amount Vs and the count value N stored in the EEPROM 134 with the ink discharge amount Dh of which discharge has been instructed in S19 at the last minute. Then, the controller 130 executes the processing of S56 and thereafter by using the count value N updated in S59.

That is, the controller 130 executes the count processing for each cartridge 200 whenever the ink is discharged through the head 21. For example, for one cartridge 200, the remaining amount update processing is executed for a while after the cartridge is installed in the installation case 150 (S51:L→L), the processing of S53 to S57 is executed just once at timing at which the output of the liquid level sensor 155 has changed (S51:L→H), and the processing of S58 to S59, S56 to S57 is thereafter executed until the ink in the tank 160 is exhausted (S51:H→H).

Advantages

According to the above illustrative embodiment, even when the heights of the liquid levels of the liquid chambers 210, 171 are different at the time at which the cartridge 200 is installed in the installation case 150, the printer 10 can individually calculate the ink amounts Vc, Vs in accordance with the equations 1 to 4 for the time period until the liquid levels of the liquid chambers 210, 171 are flush with each other. However, since the ink is not moved if the cartridge 200 is removed from the installation case 150, the printer 10 preferably stops the processing of S32 to S35 when the high level signal is output from the mounting sensor 154, irrespective of whether the heights Hc, Hs are less than the threshold height $H_{th}$.

As discussed above, the disclosure may provide at least the following illustrative, non-limiting embodiments.

(1) A liquid discharge apparatus comprising: an installation case configured to receive a cartridge, the cartridge including: a first liquid chamber storing a liquid; a first flow path, one end of the first flow path communicated with the first liquid chamber, the other end of the first flow path communicated with the outside; and a second flow path, one end of the second flow path communicated with the first liquid chamber; the other end of the second flow path communicated with the outside; a tank including: a second liquid chamber; a third flow path, one end of the third flow path communicated with the outside, the other end of the third flow path communicated with the second liquid chamber, at least one of the first flow path and the third flow path configured to communicate with the first liquid chamber of the cartridge installed in the installation case and the second liquid chamber; a fourth flow path, one end of the fourth flow path being below the other end of the third flow path and communicate with the second liquid chamber; and a fifth flow path, one end of the fifth flow path communicated with the second liquid chamber, the other end of the fifth flow path communicated with the outside; a head communicated with the other end of the fourth flow path; an apparatus memory storing a liquid amount Vc and a liquid amount Vs, the liquid amount Vc indicating amount of liquid stored in the first liquid chamber, the liquid amount Vs indicating amount of liquid stored in the second liquid chamber; and a controller configured to: determine whether the cartridge is installed in the installation case; in response to determining that the cartridge is installed in the installation case, based on a height Hc, a height Hs, a flow path resistance Rc of the second flow path, a flow path resistance Rs of the fifth flow path, and a flow path resistance Rn, calculate an outflow amount Qc, the outflow amount Qc indicating amount of the liquid flowed out from the first liquid chamber toward the second liquid chamber for a time period Δt, the height Hc being a height from a reference position to a liquid level of the first liquid chamber, the height Hs being a height from the reference position to a liquid level of the second liquid chamber, the third flow path resistance Rn being a resistance of one or both of the first flow path and the third flow path; read out the liquid amount Vc and the liquid amount Vs from the apparatus memory; subtract the outflow amount Qc from the read liquid amount Vc, so as to calculate the liquid amount Vc after the time period Δt elapses; add the outflow amount Qc to the read liquid amount Vs, so as to calculate the liquid amount Vs after the time period Δt elapses; store the calculated liquid amount Vc and the calculated liquid amount Vs in the apparatus memory; stand by from at the time storing the calculated liquid amount Vc and the calculated liquid amount Vs in the apparatus memory until the time period Δt elapses; and in response to the elapse of the time period Δt, again calculate the outflow amount Qc, the liquid amount Vc and the liquid amount Vs and store the calculated liquid amount Vc and the calculated liquid amount Vs in the apparatus memory.

According to the above configuration, even when the heights of the liquid levels of the first liquid chamber and the second liquid chamber are different at the time at which the cartridge is installed in the liquid discharge apparatus, it is possible to perceive the liquid amounts Vc, Vs in real time for a time period until the liquid levels of the first liquid chamber and the second liquid chamber are flush with each other.

(2) The liquid discharge apparatus of (1), wherein the controller is configured to: based on the calculated liquid amount Vc, determine the height Hc; and based on the calculated liquid amount Vs, determine the height Hs.

(3) The liquid discharge apparatus of (2), wherein the controller is configured to: based on first correspondence information, determine the height Hc, the first correspondence information indicating a correspondence between the calculated liquid amount Vc and the height Hc; and based on second correspondence information, determine the height Hs, the second correspondence information indicating a correspondence between the calculated liquid amount Vs and the height Hs.

(4) The liquid discharge apparatus of (3), wherein the controller is configured to: determine whether the calculated liquid amount Vs is equal to or less than a threshold amount; in a case where the calculated second liquid amount Vs is equal to or less than the threshold amount, determine the height Hs corresponding to the calculated liquid amount Vs as zero; and in a case where the calculated second liquid amount Vs is greater than the threshold amount, determine the height Hs based on the second correspondence information, and wherein the threshold amount corresponds to a volume of a part of the second liquid chamber equal to or lower than a communication position with the third flow path.

(5) The liquid discharge apparatus of (2), wherein the controller is configured to: determine whether a difference between the determined height Hc and the determined Hs is less than a threshold height, in response to determining that the difference between the determined height Hc and the determined Hs is not less than the threshold height, stand by from at the time storing calculated liquid amount Vc and the calculated liquid amount Vs in the apparatus memory until the time period Δt elapses.

(6) The liquid discharge apparatus of (2), wherein the controller is configured to, lengthen the time period Δt until the outflow amount Qc, the liquid amount Vc and the liquid amount Vs are calculated next time, as the difference between the calculated height Hc and the calculated height Hs comes close to the threshold height.

The outflow amount Qc increases as the difference between the heights Hc, Hs increases and decreases as the difference between the heights Hc, Hs decreases. Therefore, like the above configuration, when an update frequency of the liquid amounts Vc, Vs is changed in correspondence to the difference between the heights Hc, Hs, it is possible both to perceive the liquid amounts Vc, Vs in real time and to reduce a processing load of the controller.

(7) The liquid discharge apparatus of any one of (1) to (6), wherein the controller is configured to, in response to determining that the cartridge is not installed in the installation case, stop the calculating of the outflow amount Qc, the amount Vc and the liquid amount Vs and storing the calculated liquid amount Vc and the calculated liquid amount Vs in the apparatus memory.

Since the liquid is not moved through the third flow path if the cartridge is removed, it is preferable to stop the update of the liquid amounts Vc, Vs, irrespective of whether the heights Hc, Hs are flush with each other, like the above configuration.

(8) The liquid discharge apparatus of any one of (5) to (7), wherein the controller is configured to, in response to determining that the difference between the height Hc and the height Hs is less than the threshold height, stop the calculating of the outflow amount Qc, the liquid amount Vc and the liquid amount Vs and the storing of the calculated liquid amount Vc and the calculated liquid amount Vs in the apparatus memory.

(9) The liquid discharge apparatus of any one of (1) to (8), further comprising an interface, wherein the cartridge includes a cartridge memory, and wherein the controller is configured to store the calculated liquid amount Vc in the cartridge memory via the interface.

According to the above configuration, when the cartridge removed from the liquid discharge apparatus is installed in other liquid discharge apparatus, the other liquid discharge apparatus can appropriately perceive the amount of the liquid stored in the first liquid chamber.

(10) The liquid discharge apparatus of (9), further comprising: a cover moveable between a first position and a second position, the cover at the first position covering an opening, the cover at the second position exposing the opening; and a cover sensor, wherein the installation case defines the opening through which the cartridge being installed in the installation case is to be passed, wherein the controller is configured to, in response to receiving one signal from the cover sensor, store the calculated liquid amount Vc in the cartridge memory, the one signal being output from the cover sensor when the cover is located at the exposed position, and wherein the controller is configured not to, in response to receiving the other signal from the cover sensor, store the calculated liquid amount Vc in the cartridge memory, the other signal being output from the cover sensor when the cover is located at the covering position.

In the liquid discharge apparatus configured as described above, the cartridge can be removed only when the cover is located at the exposed position. Therefore, like the above configuration, only when the third signal is output from the cover sensor, the liquid amount Vc of the cartridge memory is updated, so that it is possible to reduce the number of access times to the cartridge memory.

(11) The liquid discharge apparatus according to (9), further comprising a cover moveable between a first position and a second position, the cover at the first position covering an opening, the cover at the second position exposing the opening, wherein the installation case defines the opening through which the cartridge being installed in the installation case is to be passed, wherein the controller is configured to detect a position of the cover, wherein the controller is configured to, in response to detecting that the cover is located at the second position, store the calculated liquid amount Vc in the cartridge memory, and wherein the controller is configured not to, in response to detecting that the cover is located at the first position, store the calculated liquid amount Vc in the cartridge memory.

(12) The liquid discharge apparatus of any one of (1) to (11), further comprising: an interface, wherein the cartridge comprises a cartridge memory, and wherein in response to determining that the cartridge is installed in the installation case, the controller is configured to: read out the liquid amount Vc from the cartridge memory; and store the read liquid amount Vc in the apparatus memory via the interface.

According to the above configuration, even when the capacity of the first liquid chamber is different for each cartridge or even with the cartridge removed from the other liquid discharge apparatus, it is possible to appropriately update the liquid amounts Vc, Vs.

(13) The liquid discharge apparatus of any one of (2) to (12), wherein the controller is configured to: receive a discharge instruction to discharge liquid; based on the received discharge instruction, control the head to discharge the liquid; determine a discharge amount Dh of the liquid indicated in the received discharge instruction; based on the determined discharge amount Dh, calculate an outflow amount Qa, the outflow amount Qa indicating amount of the liquid flowed out from the fourth flow path toward the head for a discharging time period Δt during which the liquid is discharged through the head; based on the determined height Hc and the determined height Hs, the calculated outflow amount Qa, the flow path resistance Rc, the flow path resistance Rs, and the flow path resistance Rn, calculate the outflow amount Qc of the liquid flowed out from the first liquid chamber toward the second liquid chamber for the discharging time period Δt; read out the liquid amounts Vc and the liquid amount Vs from the apparatus memory; subtract the outflow amount Qc from the read liquid amount Vc, so as to calculate the liquid amount Vc after the discharging time period Δt elapses; subtract the outflow amount Qa from the read liquid amount Vs and to add the outflow amount Qc to the read liquid amount Vs, so as to calculate the liquid amount Vs after the discharging time period Δt elapses; and store the calculated liquid amount Vc and the calculated liquid amount Vs in the apparatus memory.

According to the above configuration, even when a difference occurs between the heights of the liquid levels of the first liquid chamber and the second liquid chamber as the head is caused to discharge the liquid, it is possible to individually calculate the liquid amounts Vc, Vs respectively stored in the first liquid chamber and the second liquid chamber.

(14) The liquid discharge apparatus of (13), wherein the controller is configured to, in response to the discharge of the liquid through the head being terminated, calculate the discharge amount Dh by dividing a total discharge amount of the liquid indicated in the discharge instruction by a discharge time period; and based on the calculated discharge amount Dh, calculate the outflow amount Qa, the outflow amount Qc, the liquid amount Vc, and the liquid amount Vs and store the calculated liquid amount Vc and the calculated liquid amount Vs in the apparatus memory.

(15) The liquid discharge apparatus of any one of (1) to (14), further comprising a display, wherein the controller is configured to display, on the display, information indicative of each of the calculated liquid amount Vc and the calculated liquid amount Vs.

(16) The liquid discharge apparatus of any one of (1) to (15), wherein the controller is configured to, in response to the calculated liquid amount Vs being below a threshold amount, prohibit the liquid from being discharged through the head.

According to the above configuration, even in a state where a difference occurs between the heights of the liquid levels of the first liquid chamber and the second liquid chamber, the liquid discharge apparatus can operate by using the appropriate liquid amounts Vc, Vs.

(17) A liquid discharge apparatus comprising: a cartridge comprising: a first liquid chamber storing a liquid; a first flow path, one end of the first flow path communicated with the first liquid chamber, the other end of the first flow path communicated with the outside; and a second flow path, one end of the second flow path communicated with the first liquid chamber, the other end of the second flow path communicated with the outside; an installation case configured to receive the cartridge; a tank including: a second liquid chamber; a third flow path, one end of the third flow path communicated with the outside, the other end of the third flow path communicated with the second liquid chamber, at least one of the first flow path and the third flow path configured to communicate with the first liquid chamber of the cartridge installed in the installation case and the second liquid chamber; a fourth flow path, one end of the fourth flow path being below the other end of the third flow path and communicate with the second liquid chamber; and a fifth flow path, one end of the fifth flow path communicated with the second liquid chamber, the other end of the fifth flow path communicated with the outside; a head communicated with the other end of the fourth flow path; an apparatus memory storing a liquid amount Vc and a liquid amount Vs, the liquid amount Vc indicating amount of liquid stored in the first liquid chamber, the liquid amount Vs indicating amount of liquid being stored in the second liquid chamber; and a controller is configured to: determine whether the cartridge is installed in the installation case; in response to determining that the cartridge is installed in the installation case, based on a height Hc, a height Hs, a flow path resistance Rc of the second flow path, a flow path resistance Rs of the fifth flow path, and a flow path resistance Rn, calculate an outflow amount Qc, the outflow amount Qc indicating amount of the liquid flowed out from the first liquid chamber toward the second liquid chamber for a time period Δt, the height Hc being a height from a reference position to a liquid level of the first liquid chamber, the height Hs being a height from the reference position to a liquid level of the second liquid chamber, the third flow path resistance Rn being a resistance of one or both of the first flow path and the third flow path; read out the liquid amount Vc and the liquid amount Vs from the apparatus memory; subtract the outflow amount Qc from the read liquid amount Vc, so as to calculate the liquid amount Vc after the time period Δt elapses; add the outflow amount Qc to the read liquid amount Vs, so as to calculate the liquid amount Vs after the time period Δt elapses; store the calculated liquid amount Vc and the liquid amount Vs in the apparatus memory; stand by from at the time storing the calculated liquid amount Vc and the calculated liquid amount Vs in the apparatus memory until the time period Δt elapses; and in response to the elapse of the time period Δt, again calculate the outflow amount Qc, the liquid amount Vc, and the liquid amount Vs and store the calculated liquid amount Vc and the calculated liquid amount Vs in the apparatus memory.

According to the disclosure, even when the heights of the liquid levels of the first liquid chamber and the second liquid chamber are different at the time at which the cartridge is installed in the liquid discharge apparatus, it is possible to perceive the liquid amounts Vc, Vs in real time for the time period until the liquid levels of the first liquid chamber and the second liquid chamber are flush with each other.

What is claimed is:

1. A liquid discharge apparatus comprising:

an installation case configured to receive a cartridge, the cartridge including:

a first liquid chamber storing a liquid;

a first flow path, one end of the first flow path communicated with the first liquid chamber, the other end of the first flow path communicated with the outside; and a second flow path, one end of the second flow path communicated with the first liquid chamber; the other end of the second flow path communicated with the outside;

a tank including:

a second liquid chamber;

a third flow path, one end of the third flow path communicated with the outside, the other end of the third flow path communicated with the second liquid chamber, at least one of the first flow path and the third flow path configured to communicate with the first liquid chamber of the cartridge installed in the installation case and the second liquid chamber;

a fourth flow path, one end of the fourth flow path being below the other end of the third flow path and communicate with the second liquid chamber; and a fifth flow path, one end of the fifth flow path communicated with the second liquid chamber, the other end of the fifth flow path communicated with the outside;

a head communicated with the other end of the fourth flow path;

an apparatus memory storing a first liquid amount Vc and a first liquid amount Vs, the first liquid amount Vc indicating amount of liquid stored in the first liquid chamber, the first liquid amount Vs indicating amount of liquid stored in the second liquid chamber; and a controller configured to:

determine whether the cartridge is installed in the installation case;

in response to determining that the cartridge is installed in the installation case, calculate an outflow amount Qc, the outflow amount Qc indicating amount of the liquid flowed out from the first liquid chamber toward the second liquid chamber for a time period Δt;

calculate a first new liquid amount Vc and a first new liquid amount Vs based on the calculated outflow amount Qc, the first liquid amount Vc and the first liquid amount Vs; and update the first liquid amount Vc and the first liquid amount Vs stored in the apparatus memory with the calculated first new liquid amount Vc and the calculated first new liquid amount Vs, respectively.

2. The liquid discharge apparatus according to claim 1, wherein the controller is further configured to:

stand by, from the time of updating the calculated first new liquid amount Vc and the calculated first new liquid amount Vs in the apparatus memory, until the time period Δt elapses; and after the time period Δt elapses, again:

determine whether the cartridge is installed in the installation case;

calculate the outflow amount Qc;

calculate a second new liquid amount Vc and a second new liquid amount Vs; and update the calculated first new liquid amount Vc and the calculated first new liquid amount Vs with the calculated second new liquid amount Vc and the calculated second new liquid amount Vs, respectively.

3. The liquid discharge apparatus according to claim 1, wherein the controller is further configured to calculate the outflow amount Qc based on a height Hc, a height Hs, a flow path resistance Rc of the second flow path, a flow path resistance Rs of the fifth flow path, and a flow path resistance Rn, the height Hc being a height from a reference position to a liquid level of the first liquid chamber, the height Hs being a height from the reference position to a liquid level of the second liquid chamber, and the third flow path resistance Rn being a resistance of one or both of the first flow path and the third flow path.

4. The liquid discharge apparatus according to claim 3, wherein the controller is further configured to:

determine the height Hc based on the calculated first new liquid amount Vc; and determine the height Hs based on the calculated first new liquid amount Vs.

5. The liquid discharge apparatus according to claim 4, wherein the controller is further configured to:

determine the height Hc based on first correspondence information, the first correspondence information indicating a correspondence between the calculated first new liquid amount Vc and the height Hc; and determine the height Hs based on second correspondence information, the second correspondence information indicating a correspondence between the calculated first new liquid amount Vs and the height Hs.

6. The liquid discharge apparatus according to claim 5, wherein the controller is further configured to:

determine whether the calculated first new liquid amount Vs is equal to or less than a threshold amount;

in a case where the calculated first new liquid amount Vs is equal to or less than the threshold amount, determine the height Hs corresponding to the calculated first liquid amount Vs as zero; and in a case where the calculated first new liquid amount Vs is greater than the threshold amount, determine the height Hs based on the second correspondence information, and wherein the threshold amount corresponds to a volume of a part of the second liquid chamber equal to or lower than a communication position with the third flow path.

7. The liquid discharge apparatus according to claim 4, wherein the controller is further configured to:

determine whether a difference between the determined height Hc and the determined Hs is less than a threshold height, in response to determining that the difference between the determined height Hc and the determined Hs is not less than the threshold height, stand by, from the time of storing the calculated first new liquid amount Vc and the calculated first new liquid amount Vs in the apparatus memory, until the time period Δt elapses.

8. The liquid discharge apparatus according to claim 7, wherein the controller is further configured to, in response to determining that the difference between the height Hc and the height Hs is less than the threshold height, stop calculating any outflow amount Qc, stop calculating any new liquid amount Vc, stop calculating any new liquid amount Vs, and stop updating any liquid amount Vc and any liquid amount Vs.

9. The liquid discharge apparatus according to claim 4, wherein the controller is further configured to, lengthen the time period Δt until any outflow amount Qc, any liquid amount Vc and any liquid amount Vs are calculated again, as the difference between the calculated height Hc and the calculated height Hs comes close to the threshold height.

10. The liquid discharge apparatus according to claim 1, wherein the controller is further configured to:

subtract the outflow amount Qc from the first liquid amount Vc, so as to calculate a second new liquid amount Vc; and add the outflow amount Qc to the first liquid amount Vs, so as to calculate a second new liquid amount Vs.

11. The liquid discharge apparatus according to claim 1, wherein the controller is further configured to, in response to determining that the cartridge is not installed in the installation case, stop calculating any outflow amount Qc, stop calculating any new liquid amount Vc, stop calculating any new liquid amount Vs, and stop updating any liquid amount Vc and any liquid amount Vs.

12. The liquid discharge apparatus according to claim 1, further comprising an interface, wherein the cartridge further comprises a cartridge memory, and wherein the controller is further configured to update the first liquid amount Vc in the cartridge memory with the calculated first new liquid amount Vc via the interface.

13. The liquid discharge apparatus according to claim 1, further comprising:

an interface, wherein the cartridge further comprises a cartridge memory, and wherein in response to determining that the cartridge is installed in the installation case, the controller is further configured to:

read out the first liquid amount Vc from the cartridge memory; and store the first liquid amount Vc in the apparatus memory via the interface.

14. The liquid discharge apparatus according to claim 1, further comprising a display, wherein the controller is further configured to display, on the display, information indicative of each of the calculated first new liquid amount Vc and the calculated first new liquid amount Vs.

15. The liquid discharge apparatus according to claim 1, wherein the controller is further configured to, in response to the calculated first new liquid amount Vs being below a threshold amount, prohibit the liquid from being discharged through the head.

16. A liquid discharge apparatus comprising:

the cartridge according to claim 1.

* * * * *